US012053029B1

(12) United States Patent
Benjamin

(10) Patent No.: US 12,053,029 B1
(45) Date of Patent: Aug. 6, 2024

(54) SYSTEMS AND METHODS FOR TESTING ONE OR MORE SMOKING ARTICLES

(71) Applicant: Data Sciences International Inc., St. Paul, MN (US)

(72) Inventor: Aaron Benjamin, Maplewood, MN (US)

(73) Assignee: Data Science International, Inc., Saint Paul, MN (US)

( * ) Notice: Subject to any disclaimer, the term of this patent is extended or adjusted under 35 U.S.C. 154(b) by 647 days.

(21) Appl. No.: 17/235,264

(22) Filed: Apr. 20, 2021

Related U.S. Application Data

(60) Provisional application No. 63/013,293, filed on Apr. 21, 2020.

(51) Int. Cl.

| | |
|---|---|
| ***A24F 40/485*** | (2020.01) |
| ***A24F 40/51*** | (2020.01) |
| ***A24F 40/80*** | (2020.01) |
| ***A24F 40/90*** | (2020.01) |
| ***A24F 42/90*** | (2020.01) |

(52) U.S. Cl.
CPC ..... *A24F 40/80* (2020.01); *A24F 40/485* (2020.01); *A24F 40/51* (2020.01); *A24F 42/90* (2020.01)

(58) Field of Classification Search
CPC .... A24F 42/90; A24F 40/485; A61M 15/0086
See application file for complete search history.

(56) References Cited

U.S. PATENT DOCUMENTS

| | | | | |
|---|---|---|---|---|
| 4,630,210 | A | 12/1986 | Salazar et al. | |
| 5,638,267 | A | 6/1997 | Singhose et al. | |
| 5,924,975 | A | 7/1999 | Goldowsky | |
| 9,476,415 | B2 | 10/2016 | Sivaramakrishn et al. | |
| 9,722,519 | B2 | 8/2017 | Shreve et al. | |
| 2015/0275890 | A1 | 10/2015 | Sivaramakrishn et al. | |
| 2021/0321677 | A1* | 10/2021 | Benjamin | A24F 40/40 |
| 2023/0263968 | A1* | 8/2023 | Benjamin | A61M 15/0086 128/204.22 |

FOREIGN PATENT DOCUMENTS

| | | |
|---|---|---|
| EP | 1832745 | 12/2017 |
| EP | 3043860 | 5/2019 |

(Continued)

OTHER PUBLICATIONS chtechusa.com [online], "Human Puff Profile Cigarette Smoking Machine (CSM-HPP)," available on or before Mar. 27, 2016, via Internet Archive: Wayback Machine URL <http://web.archive.org/web/20160327125549/https://chtechusa.com/products_tag_smoke_human-puff-profile-CSM-HPP.php>, retrieved on Oct. 20, 2021, URL <https://chtechusa.com/products_tag_smoke_human-puff-profile-CSM-HPP.php>, 2 pages.

(Continued)

*Primary Examiner* — Hae Moon Hyeon
(74) *Attorney, Agent, or Firm* — Fish & Richardson P.C.

(57) ABSTRACT

This document generally describes a system and method configured to generate vapor samples from one or more smoking articles used for testing purposes. The system can be configured in a manner that generates a predetermined flow profile by driving a fluid pump in a scheme that accounts for fluid inertia.

18 Claims, 21 Drawing Sheets

(56) References Cited

FOREIGN PATENT DOCUMENTS

| | | | | |
|---|---|---|---|---|
| KR | 101378824 | | 3/2014 | |
| WO | WO-2021216508 | A1 * | 10/2021 | ..... A24F 40/40 |

OTHER PUBLICATIONS

Collins [online], "How to calculate velocity from triangular and trapezoidal move profiles," linearmotiontips.com, Aug. 17, 2016, 15 pages.

Havel et al., "An Electronic Cigarette Vaping Machine for the Characterization of Aerosol Delivery and Composition," Oxford University Press, Received Sep. 16, 2015, Accepted May 25, 2016, 19 pages.

Herrington et al, "Electronic cigarette solutions and resultant aerosol profiles," Journal of Chromatography A, Sep. 15, 2015, 8 pages.

Talih et al., "Effects of User Puff Topography, Device Voltage, and Liquid Nicotine Concentration on Electronic Cigarette Nicotine Yield: Measurements and Model Predictions," Oxford University Press, Sep. 3, 2014, 8 pages.

vitrocell.com [online], "Human Puff Profiles," available on or before Jul. 6, 2015, via Internet Archive: Wayback Machine URL <http://web.archive.org/web/20150706223025/http://www.vitrocell.com:80/inhalation-toxicology/smoking-machines/human-puff-profiles>, retrieved on Oct. 20, 2021, URL <http://www.vitrocell.com/inhalation-toxicology/smoking-machines/human-puff-profiles>, 2 pages.

vitrocell.com [online], "Smoking Machine VC 1 S-Type," available on or before Sep. 21, 2020, via Internet Archive: Wayback Machine URL <http://web.archive.org/web/20200921163021/https://www.vitrocell.com/inhalation-toxicology/smoking-machines/vc-1-s-type>, retrieved on Oct. 20, 2021, URL <https://www.vitrocell.com/inhalation-toxicology/smoking-machines/vc-1-s-type>, 6 pages.

* cited by examiner

SYSTEMS AND METHODS FOR TESTING ONE OR MORE SMOKING ARTICLES

CROSS REFERENCE TO RELATED APPLICATIONS

This application claims the priority to and the benefit of U.S. Provisional Application No. 63/013,293 filed Apr. 21, 2020, the entirety of which is incorporated herein by reference.

TECHNICAL FIELD

This document generally describes systems and methods used to test smoking articles, including for example, an inhalation exposure system that generates a sample smoke quantity from a smoking article and delivers the sample smoke quantity to a live test subject for inhalation.

BACKGROUND

Inhalation exposure systems may be used in laboratory or other testing environments for purposes of generating samples from at least one smoking article (e.g., cigarette, tobacco product, e-cigarette, or nicotine vapor product) and then delivering those samples generated from the smoking article to a designated chamber for testing or measurement. In many circumstances, test standards for traditional cigarettes (when sampled using such inhalation exposure systems) require a consistent and particular type of flow profile when drawing the smoking vapor sample from such cigarettes. As such, a pump, a piston assembly, or a combination thereof may be used to generate the traditional flow profile on a repeated basis. Some modern e-cigarettes or nicotine delivery instruments are designed with an added resistance or other structural differences that result in different flow characteristics (when air is drawn through the e-cigarette) as compared to that of a traditional cigarette.

SUMMARY

This document generally describes a system and method configured to generate vapor samples from one or more smoking articles (e.g., cigarette, tobacco product, e-cigarette, or nicotine vapor product), in which such vapor sample may optionally be used for testing purposes. In some implementations, the system can be configured in a manner that generates a predetermined and repeatable flow profile shape for the fluid flow drawn through each tested smoking article, such as an e-cigarette having a flow resistance from that of a traditional cigarette. Optionally, the system can employ a pressure differential generator, which may include a pump, a piston assembly, or the like, that is controlled to produce pseudotrapazoidal flow profile through the tested smoking article. For example, the system may achieve the pseudotrapezoidal flow velocity for the air swept through the tested smoking article by driving a fluid pump in a scheme that accounts for fluid inertia.

In one implementation, an innovative aspect of the subject matter described in this specification can be embodied in systems for transferring a smoking article vapor through an inhalation exposure system. The systems can include an aerosol-sensor positioned in a flowpath. The systems can include a fluid pump capable of smoking article vapor, at a variable velocity, along the flowpath to the aerosol-sensor. The systems can include a pump controller communicably coupled to the pump and comprising a processor; computer memory storing instructions that, when executed by the processor, cause the pump controller to perform operations comprising: driving the fluid pump in a first direction for a first time at an overshoot velocity; driving the fluid pump in the first direction for a second time after the first time at a target velocity less than the overshoot velocity; driving the fluid pump in a second direction for a third time after the second time at a reversal velocity; and driving the fluid pump for a fourth time in the second direction after the third time at a second reversal velocity less than the reversal velocity.

In a second implementation, systems test aerosol emissions of an aerosol-delivery device. The systems can include a processor; and computer memory storing instructions that, when executed by the processor, cause the processor to perform operations comprising: driving, in a first direction for a first time at an overshoot velocity, a fluid pump capable of pumping fluid, at a variable velocity, along a flowpath to an aerosol-sensor; driving the fluid pump in the first direction for a second time after the first time at a target velocity less than the overshoot velocity; driving the fluid pump in a second direction for a third time after the second time at a reversal velocity; and driving the fluid pump for a fourth time in the second direction after the third time at a second reversal velocity less than the reversal velocity In a third implementation, methods transfer a smoking article vapor through an inhalation exposure system. The methods comprising: driving, in a first direction for a first time at an overshoot velocity, a fluid pump capable of smoking article vapor, at a variable velocity, along a flowpath to an aerosol-sensor; driving the fluid pump in the first direction for a second time after the first time at a target velocity less than the overshoot velocity; driving the fluid pump in a second direction for a third time after the second time at a reversal velocity; and driving the fluid pump for a fourth time in the second direction after the third time at a second reversal velocity less than the reversal velocity.

Some or all of the implementations can include some, all, or none of the following features. The reversal velocity is greater than the target velocity. The operations cause the fluid in the flowpath to flow faster than the target velocity for a first duration, and then return to the target velocity for a second duration. The second duration is more than five times the first duration. The operations cause the fluid to flow along the flowpath with a velocity characterized by a pseudotrapezoidal flow pattern, the pseudotrapezoidal flow pattern having a period of greater-than-target velocity. A sensor-controller is communicably coupled to the aerosol-sensor and configured to generate a reading from the aerosol-sensor.

One or more of the embodiments described herein can optionally provide some or all of the following advantages. First, some embodiments described herein can be used to test a smoking article (or to simultaneously test a plurality of smoking articles) in a manner that generates a predetermined and repeatable flow profile shape for the fluid flow drawn through each tested smoking article. Second, particular embodiments of the system and methods described herein can draw smoking article vapor samples through flow path to a designated chamber, during which the flow profile of air drawn through each tested smoking article has a shape substantially similar to a strict trapezoidal profile. This can allow for reliable, repeatable testing to be performed with the use of testing strategies that assume trapezoidal flow profiles. Third, some optional embodiments of the system may house a controller (which may include a computer processor executing software instructions stored on a memory device) that can drive the mechanical components of the pressure differential generator to move in a selected manner to achieve a desired flow profile shaped (e.g., a trapezoidal flow profile) in which the volume displaced during lead-in (to a target flow through the smoking article) and lead-out (to zero flow through the smoking article) is less than 10% of the total volume displaced during the sample cycle. Such a benefit can be achieved, in some embodiments, even when the tested smoking article(s) comprises an e-cigarette or nicotine delivery instrument having an added resistance or other structural difference that result in different flow characteristics (when air is drawn therethrough) as compared to that of a traditional cigarette.

DETAILED DESCRIPTION

Figure 1A:
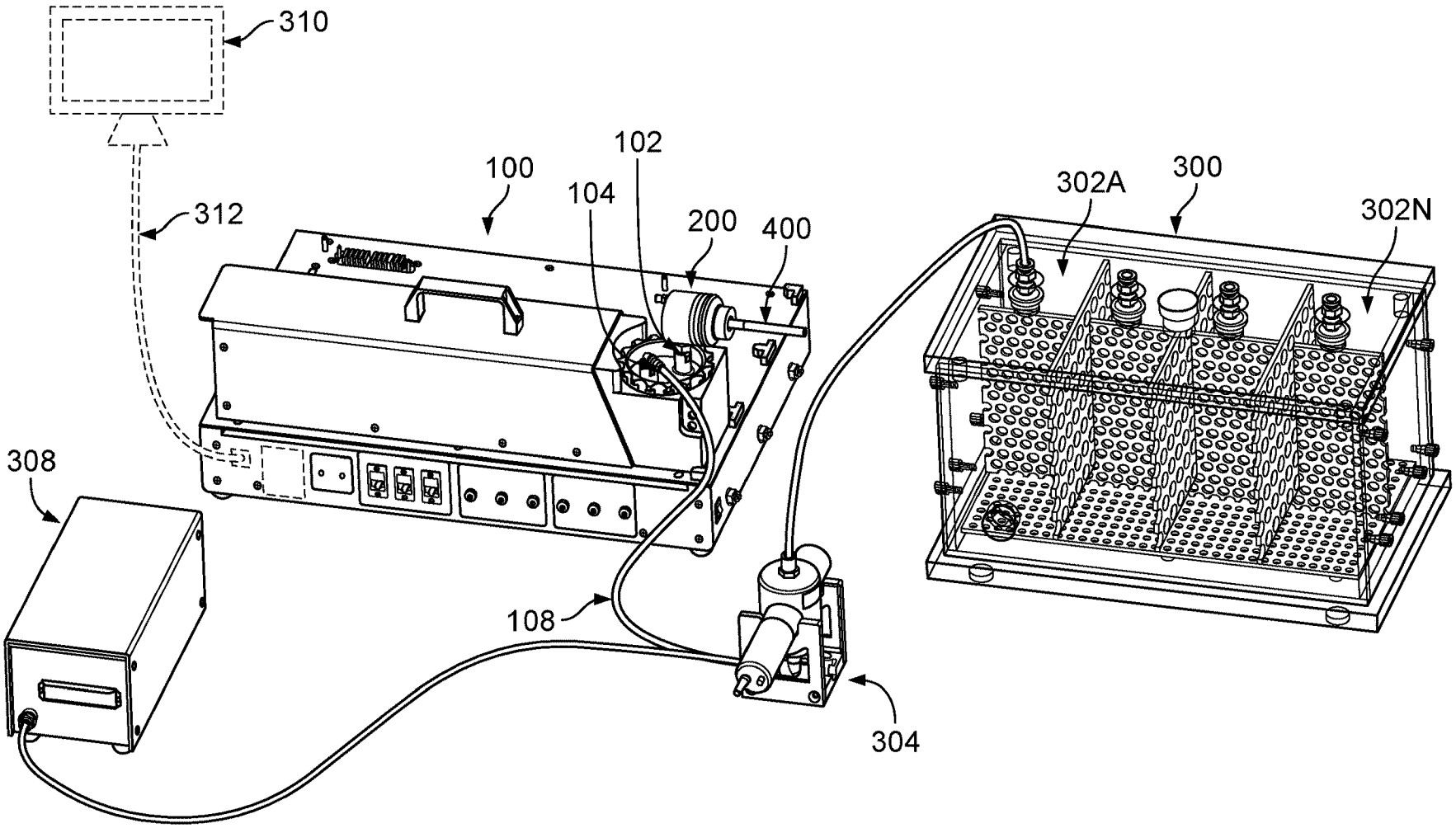
FIGS. 1A-G depict perspective views of exemplary configurations of an inhalation exposure system, in accordance with particular embodiments.

Referring to FIGS. 1A-Q some configurations of a system for generating vapor samples from at least one smoking article may be equipped with animal exposure attachments, which are used to deliver a smoking article vapor to at least one live subject (e.g., mice, rats, or other air-breathing animal) for at least one inhalation dose. For example, FIG. 1A depicts the inhalation exposure system 100 (e.g., smoke/vape generator) configured to a mass dosing chamber 300 for testing on at least one live subject. In some implementations, each section 302A-N in the mass dosing chamber 300 can house a live subject. As demonstrated in FIG. 1A, a cigarette 400 is attached to a cigarette smoking article port 200. The smoking article port 200 is configured to an input valve 102 of the inhalation exposure system 100. As the cigarette 400 is puffed (e.g., smoked), a smoking article vapor travels through the input valve 102 (e.g., port, inhale valve) and into the inhalation exposure system 100. As described in more detail below, the system 100 depicted throughout FIGS. 1A-G may include a barrier 106 positioned along the flow path of the smoking article vapor (e.g., from the input valve 102 and out through an output valve 104 in the depicted example) so as to provide some protection to components of the system 100, such as a piston assembly or a pump. This configuration is advantageous such that it can reduce the likelihood of corrosion or another type of fouling to mechanical components of the system 100 that might otherwise be detrimentally affected by exposure to smoking article vapors over an extended period of time.

Referring now to the example in FIG. 1A, after the smoking article vapor flows through the interior space along the barrier 106, it may travel through the output valve 104 (e.g., port, exhale valve) and be delivered to any one of several types of outputs. As depicted in FIG. 1A, the system 100 may be configured to deliver the smoking article vapor to a designated chamber (e.g., the mass dosing chamber 300) where at least one live subject (e.g., mice, rats, or other air-breathing animal) is exposed to at least one inhalation dose, and the live subject may be monitored over a period of time. Alternatively, the inhalation exposure system 100 may be configured for use without a live subject, and instead the smoking article vapor may be delivered to the designated chamber where at least one sensor is positioned to measure a characteristic of the sample (refer to FIGS. 1D-G). In a further alternative, the inhalation exposure system 100 may be configured for use with a live subject in the designated chamber (for exposure to exposed to at least one inhalation dose) while at least one sensor is also contemporaneously exposed to the smoking article vapor for purposes of measuring a characteristic of the sample (refer to FIGS. 1F-G). Exemplary outputs can include a multi-well cell exposure tray or any known module(s) for petri dishes, suspension cells, well-inserts, power chambers, etc.

As in the example of FIG. 1A, the smoking article vapor flows through the output valve 104 and into a tube 108 that is configured to a photometer 304. The smoking article vapor then travels through the photometer 304 and into one or more sections 302A-N of the mass dosing chamber 300. Alternatively, the photometer 304 can be removed and the smoking article vapor can flow directly from the output valve 104 and into one or more sections 302A-N of the mass dosing chamber 300. The photometer 304 can be beneficial for collecting additional data/information on the tested smoking article 400. For example, the photometer 304 can measure particle concentrations of the smoking article vapor in real-time.

Figure 1B:
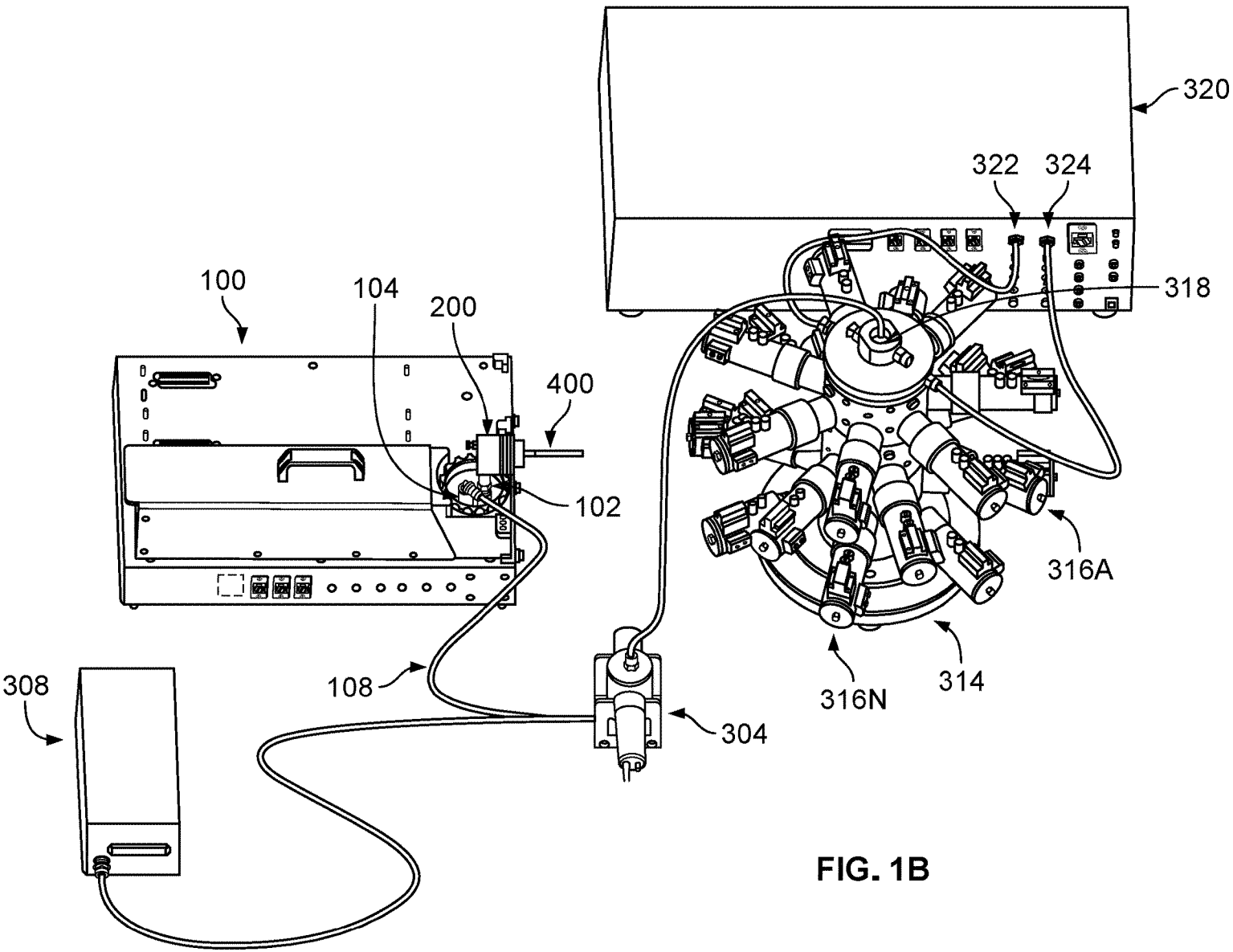
Figure 1C:
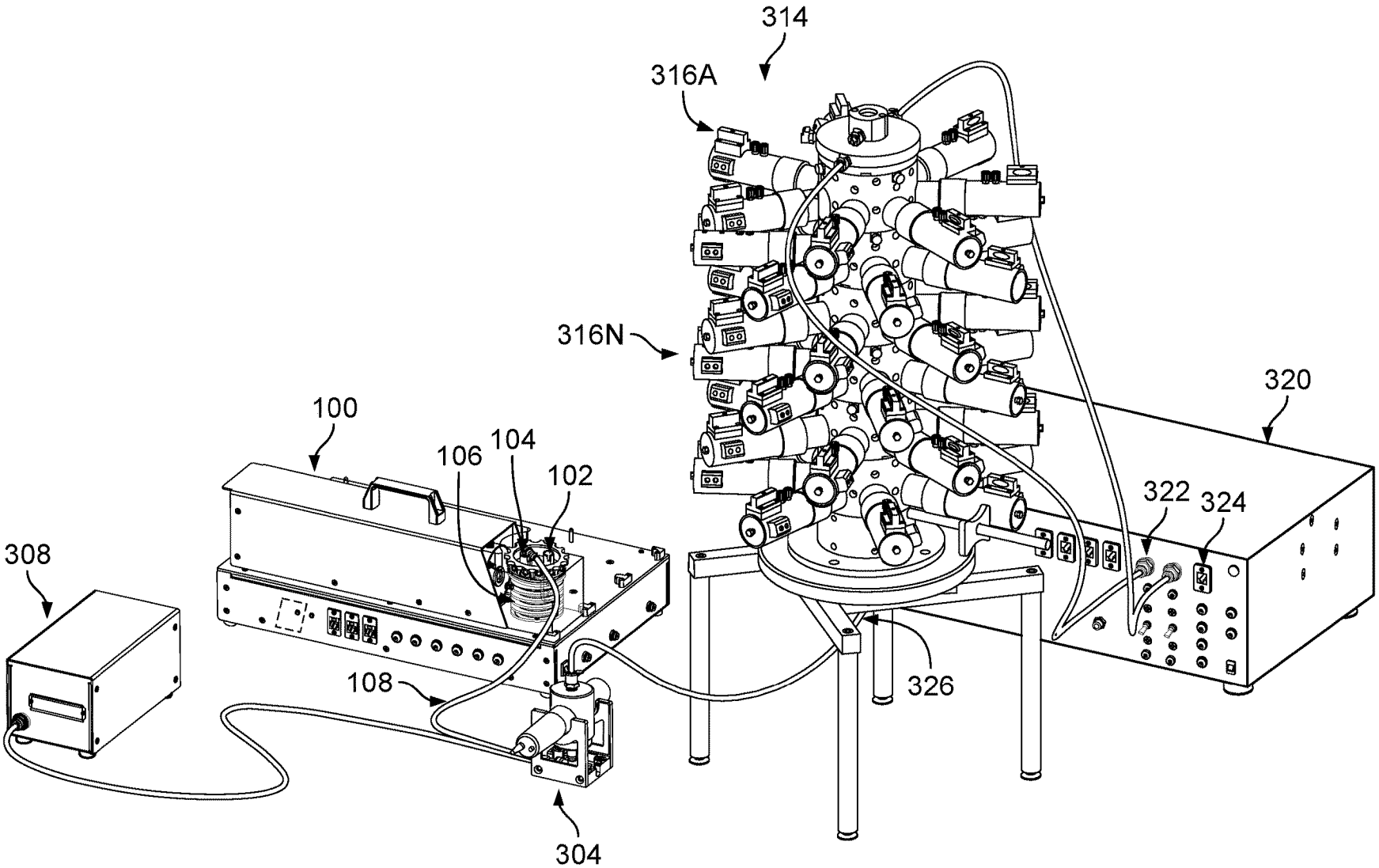
Figure 1D:
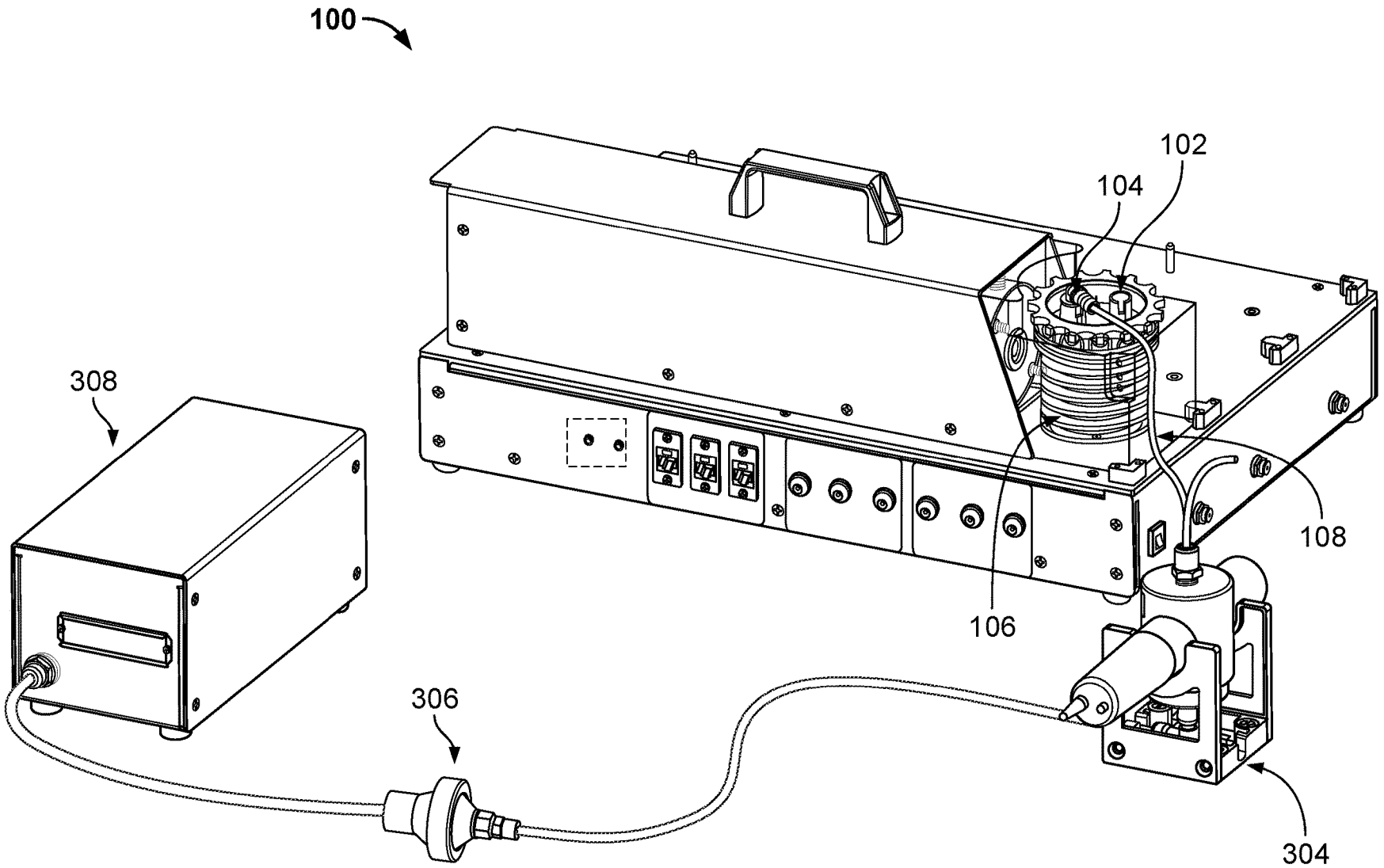
Figure 1E:
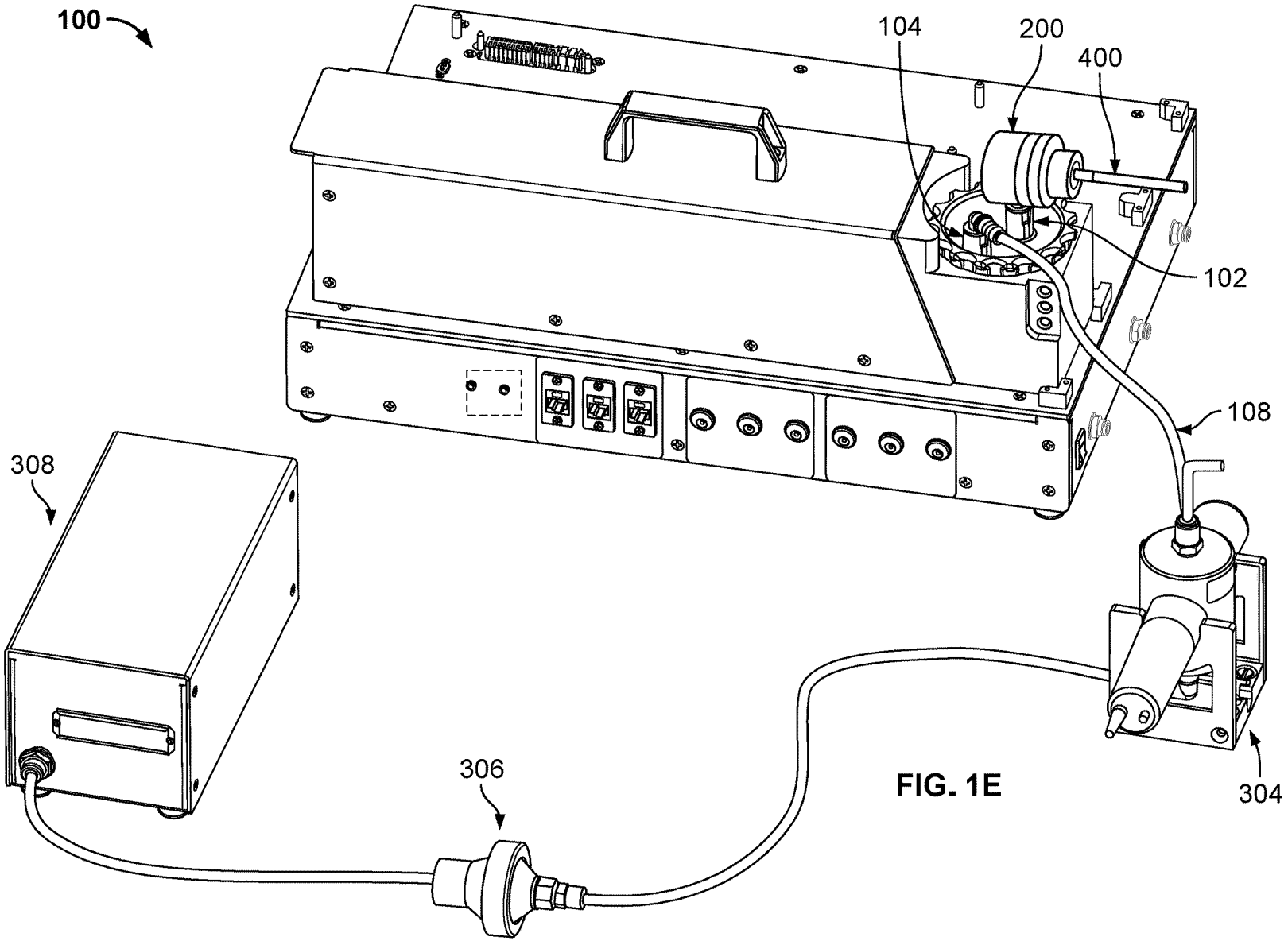

In some implementations, the smoking article vapor can also flow through a filter 306 (refer to FIG. 1D-E). Thus, the filter 306 can be attached along any one of the tubes (e.g., the tube 108) that transmits the smoking article vapor between the inhalation exposure system 100 and the mass dosing chamber 300 or other output. The filter 306 can be used in conjunction with the photometer 304. Alternatively, the filter 306 can be used without the photometer 304. The filter 306 can also be replaced with a cell culture for a cytotoxicity study.

Still referring to FIG. 1A, a supplemental flow unit 308 is connected to the photometer 304. The supplemental flow unit 308 can pump ambient air to a desired location (e.g., the photometer 304). In some implementations, the supplemental flow unit 308 can pump clean air through the photometer 304 and to the mass dosing chamber 300 to remove potential byproducts of respiration by one or more live subjects located therein and/or dilute an aerosol concentration of the smoking article vapor from the inhalation exposure system 100. Additionally, pumping ambient air from the supplemental flow unit 308 to the photometer 304 can reduce and prevent fouling of the photometer 304, The supplemental flow unit 308's direction of flow can be dependent on a desired configuration of a user. The inhalation exposure system 100 depicted herein can additionally include a power source/generator, such as a battery (not depicted). The inhalation exposure system 100 can be in communication (e.g., wired 312, by a USB, for example, and/or wireless) with a user device 310, including but not limited to a computer, tablet, phone, etc. A user can control the inhalation exposure system 100 from the user device 310, view information/data received from the inhalation exposure system 100 in real-time, and/or modify settings of the system 100 while it is in operation. For example, at the user device 310, the user can monitor each section 302A-N of the mass dosing chamber 300 that receives a flow of the smoking article vapor from the inhalation exposure system 100 (refer to FIGS. 8A-B).

FIG. 1B depicts the inhalation exposure system 100 configured to a tower 314 of individual animal chambers 316A-N. As demonstrated, the cigarette 400 is attached to the smoking article port 200. As the cigarette 400 is puffed, the smoking article vapor enters the inhalation exposure system 100. As described in more detail below, the smoking article vapor can flow through interior space along the barrier 106 before being expelled through the output valve 104 so as to reduce potential fouling, corrosion, or other damage to mechanical components of the system 100. Once through the output valve 104, the smoking article vapor can flow through the tube 108 and the photometer 304, and into an inflow valve 318 at a top surface of the tower 314. The smoking article vapor can then be distributed (e.g., equally distributed, unequally distributed by biasing to one chamber over another) to one or more chambers 316A-N (e.g., plethysmography sites) in the tower 314.

The tower 314 can retain live subjects (e.g., rats, mice), wherein each live subject is exposed to at least one inhalation dose. Chambers 316A-N that receive the smoking article vapor can be coupled to an inhalation tower controller 320. The inhalation tower controller 320 can receive the smoking article vapor through an input valve 322 from the tower 314 and measure certain conditions of that vapor before outputting the vapor through an output valve 324 and back into the tower 314. The inhalation tower controller 320 can optionally measure and/or control a tower pressure, flow, temperature, humidity, plethysmograph transducers, and photometer inputs. FIG. 1C depicts another view of the inhalation exposure system 100 coupled to the tower 314. This exemplary view depicts the inhalation exposure system 100 without a smoking article port coupled to the input valve 102. Additionally, the tower 314 is elevated off a surface/ground. When the inhalation exposure system 100 is in use and a smoking article vapor is generated, the smoking article vapor goes through the photometer 304 described herein and travels up through an inflow valve 326 at an underside of the tower 314. The components of this configuration perform as described herein.

FIGS. 1D-E depict the inhalation exposure system 100 as an in-vitro configuration with the filter 306. In the example of FIG. 1D, the input valve 102 of the inhalation exposure system 100 does not receive a smoking article port. In the example of FIG. 1E, the smoking article 400 (e.g., cigarette) is attached to the smoking article port 200 (refer to FIG. 3A), which is configured to the input valve 102. In both examples of FIGS. 1D-E, the filter 306 is an in-line filter. The filter 306 can be used for gravimetric analysis, gravimetric calibration of a photometer, and/or particle composition analysis. To work for a gravimetric calibration of the photometer, the filter may be placed downstream of the photometer. This can be done to take a tare weight of the filter and catch particulate during a run while recording photometer data. A re-weigh of the filter can provide the mass of particulate produced by the machine. Dividing this value by known flow and run time will give an average concentration (e.g., Mass/Volume.) Comparison of this value to the average output recorded on the photometer will let you apply a correction factor to the photometer data.

For a chemical analysis or in-vitro cellular analysis, the filter could be placed anywhere in the flow path downstream of the test. An example includes a filter being placed between the smoke generator and the test article to e.g., minimize the effect of material loss. If any photometer data had to be collected in conjunction with a particle composition analysis, the filter may be placed, e.g., downstream of the photometer.

In some situations, it may be advantageous to route the vape to multiple cell exposure sites, which may involve either routing the flow over a multi-well plate or routing and splitting flow through a manifold to multiple isolated sites. The filter 306 described herein can optionally be replaced with a cell culture for a cytotoxicity analysis.

Figure 1F:
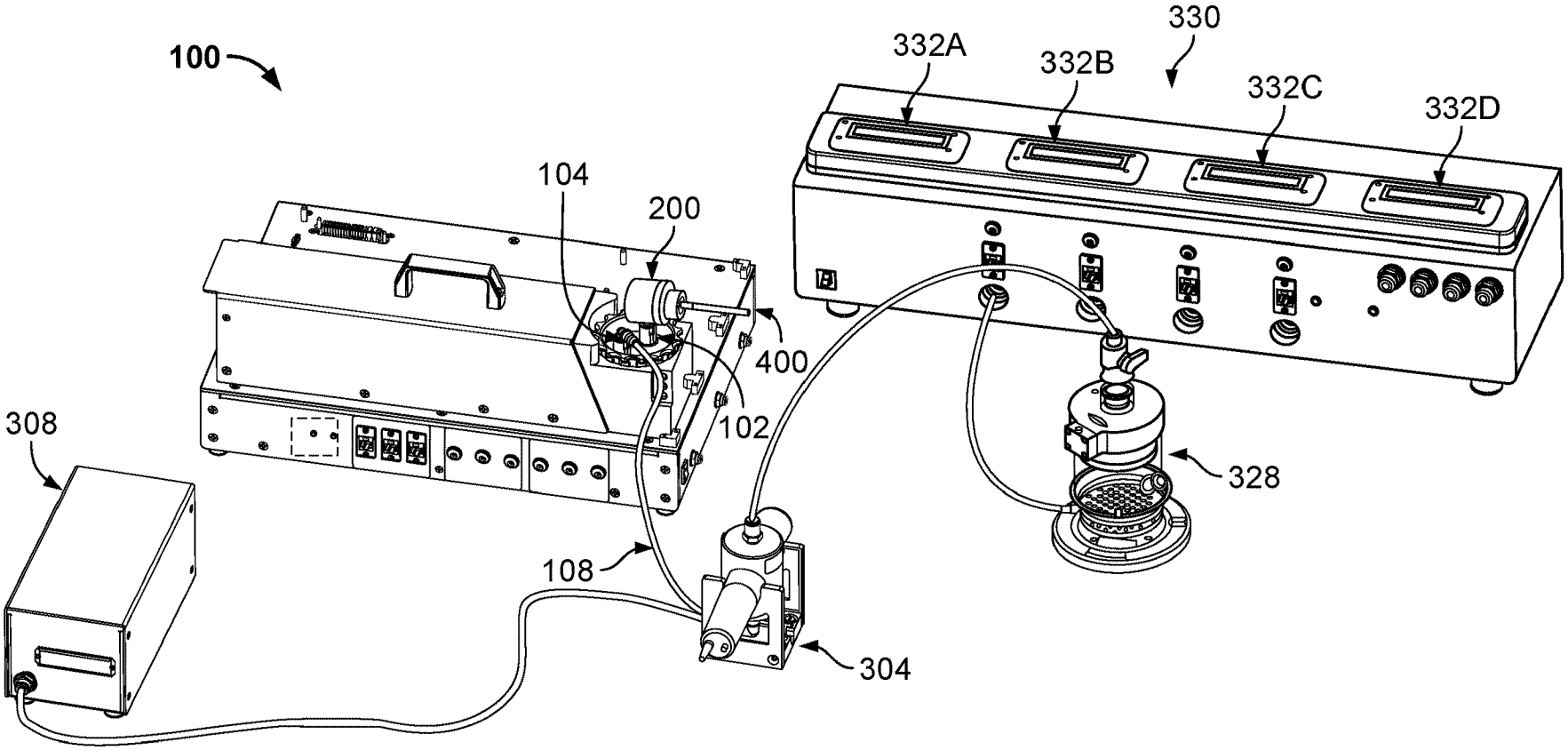
Figure 1G:
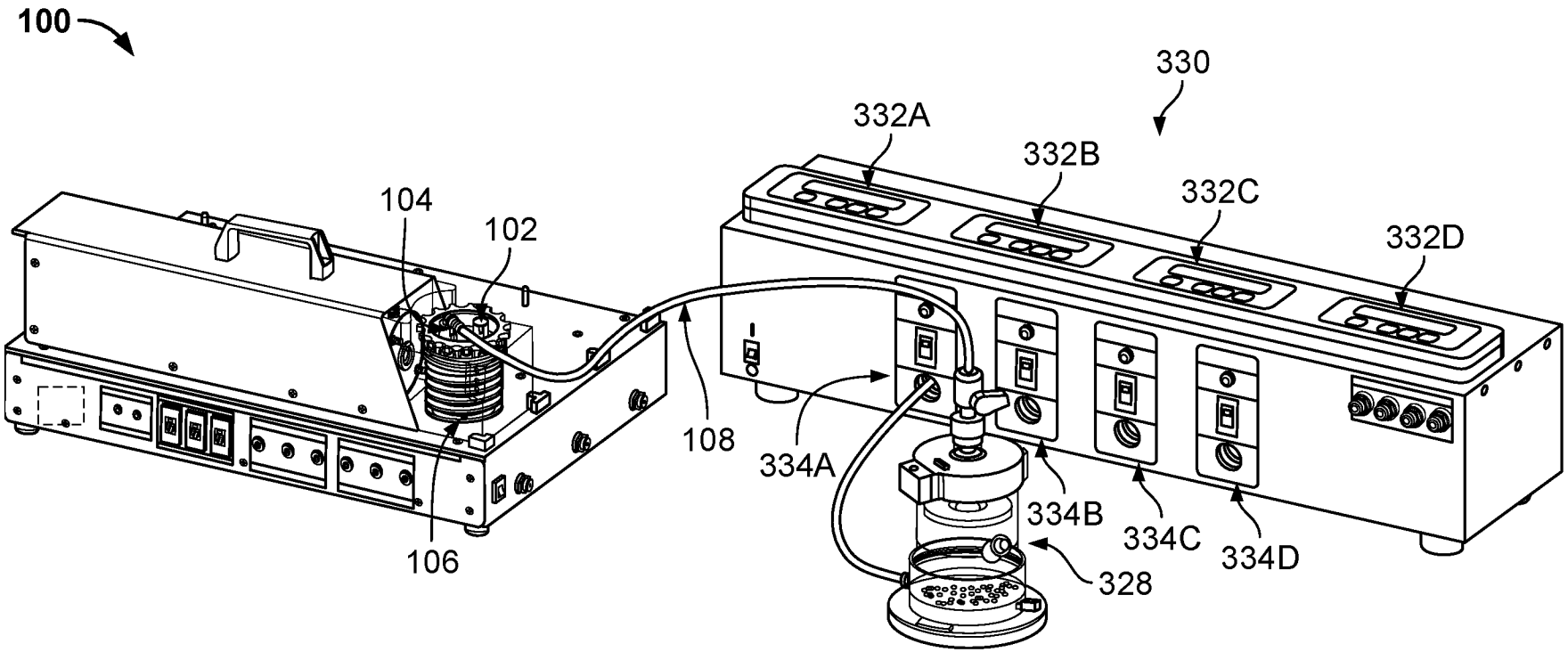

FIGS. 1F-G depict the inhalation exposure system 100 configured to a plethysmography chamber 328. The system 100 described herein can use negative pressure to pull air into the plethysmography chamber 328 and out into the ambient air. Alternatively, a negative bias flow can be used to pull air into the plethysmography chamber 328 from ambient air using a negative pressure pump and a separate controller. In some implementations, the in-line filter 306, as depicted in FIGS. 1D-E, can optionally be placed between the negative pressure pump and the plethysmography chamber 328 such that the filter 306 can collect aerosol and other particles that a live subject (e.g., animal, lab rat) does not inhale inside the plethysmography chamber 328.

FIG. 1F depicts the photometer 304 described herein coupled with the plethysmography chamber 328 and the inhalation exposure system 100. Additionally, the smoking article 400 is attached to the smoking article port 200, which is further coupled to the input valve 102 of the inhalation exposure system 100. FIG. 1G alternatively, depicts the plethysmography chamber 328 in direct connection with the output valve 104 of the inhalation exposure system 100.

In both FIGS. 1F-G the plethysmography chamber 328 is connected to a plethysmography control system 330. This system 330 can be in communication (e.g., wired and/or wireless) with a computer and/or the user device 310 (refer to FIG. 1A). The user, therefore, can monitor and view information regarding plethysmography analysis in real-time. The user can also adjust/modify properties of the plethysmography analysis. The control system 330 depicted includes four sites 332A-D that can be connected to four plethysmography chambers. In alternative embodiments, the control system 330 can have fewer or more sites. Each site 332A-D on the control system 330 includes respective sets 334A-D of input and output valves that can be used for nebulizer, transducer, and bias flow. A bias flow port (bottom of the 334A-D grouping) may be a pneumatic port only. The top port can emit a high frequency electric pulse to power a piezoelectric mesh nebulizer. The received analog signal may be received from the pressure transducer and a temperature/humidity probe if attached.

The exemplary configurations depicted in FIGS. 1A-G can be combined. For example, the tower 314 of FIGS. 1B-C can be configured with the plethysmography chamber 328 of FIG. 1F. Similarly, the filter 306 in FIGS. 1D-E can be configured to any one of the configurations depicted and described throughout this disclosure.

Figure 2A:
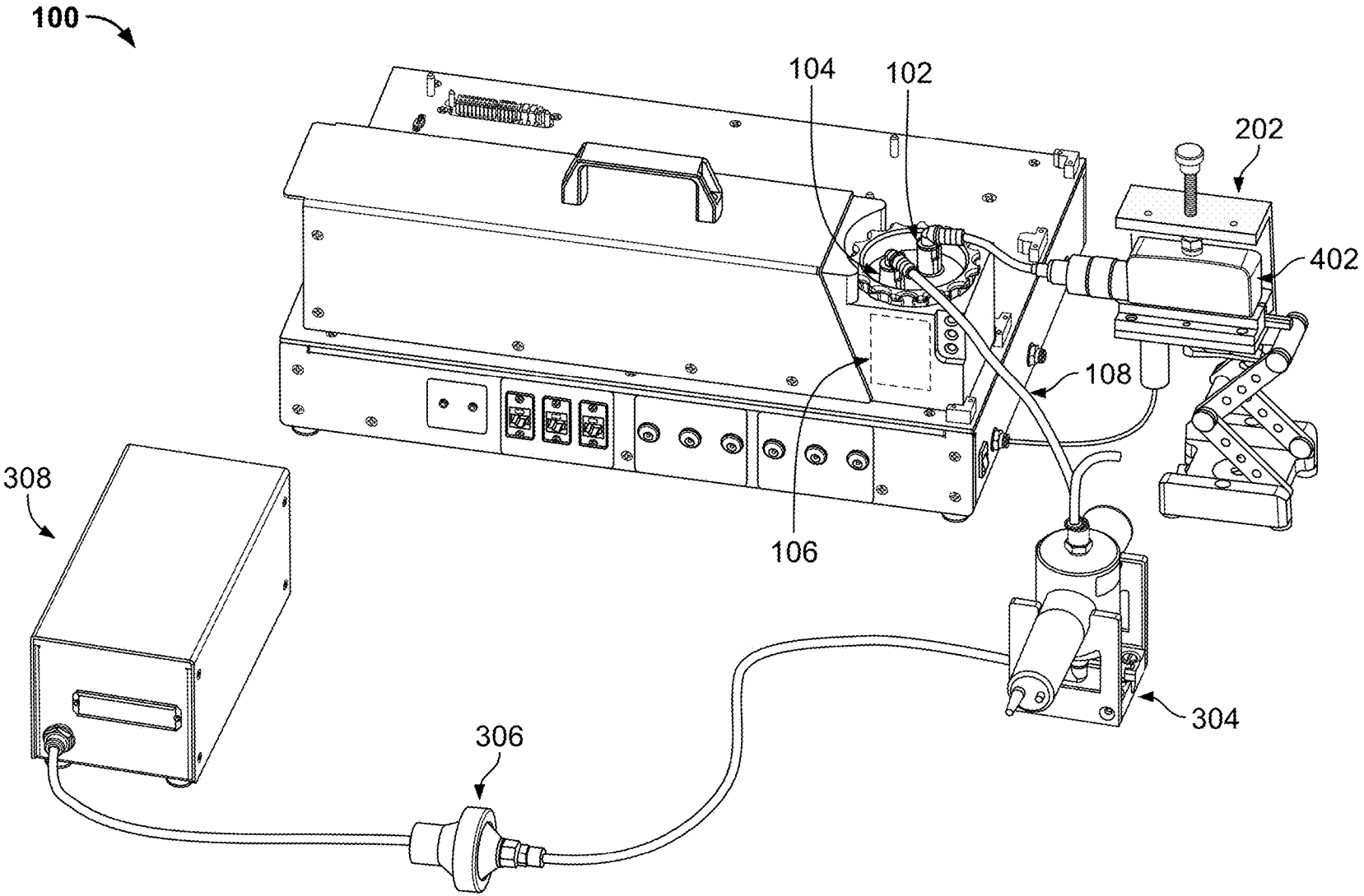
FIGS. 2A-C depict perspective views of exemplary configurations of an inhalation exposure system, in accordance with further embodiments.
Figure 2B:
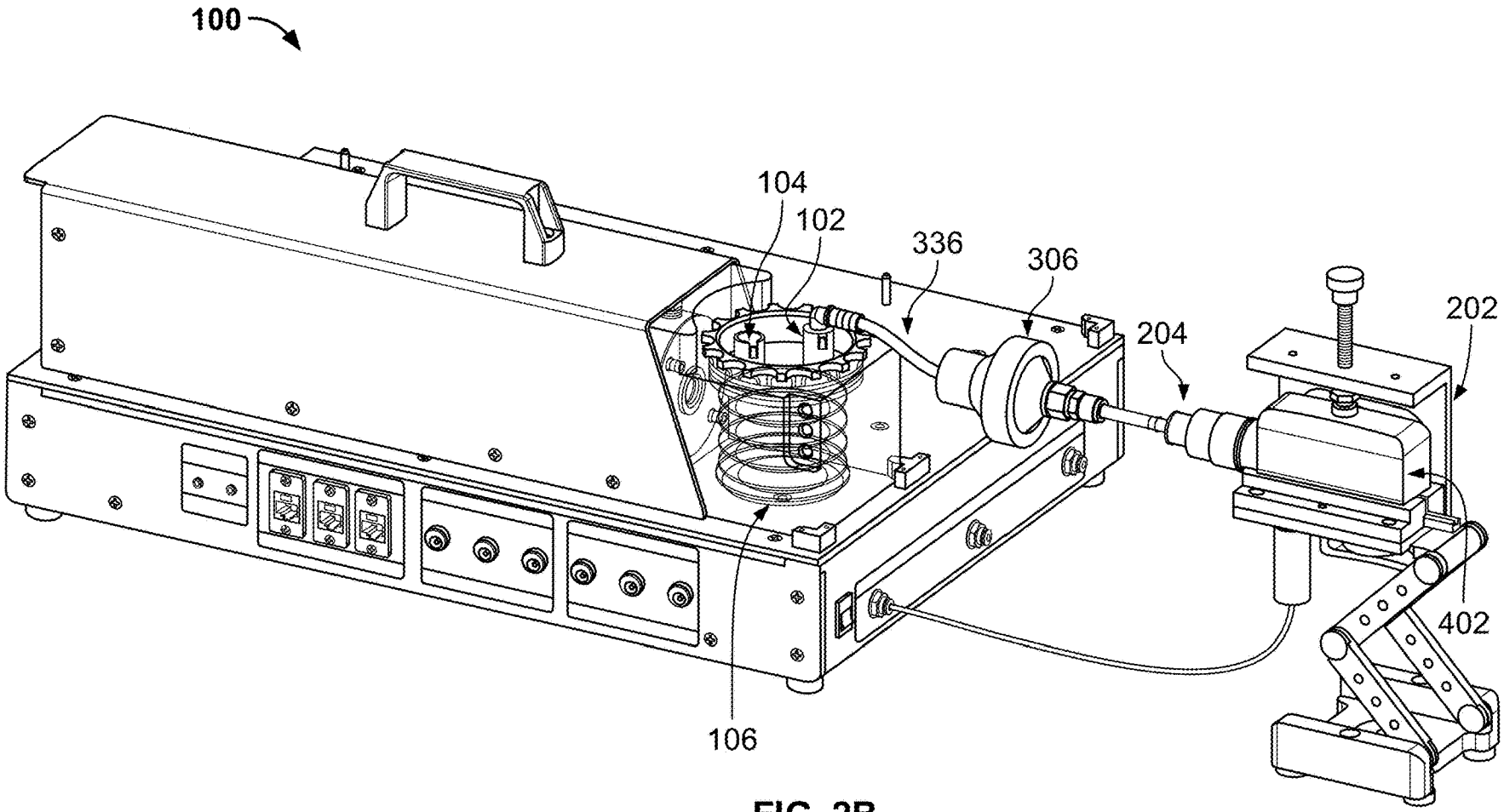
Figure 2C:
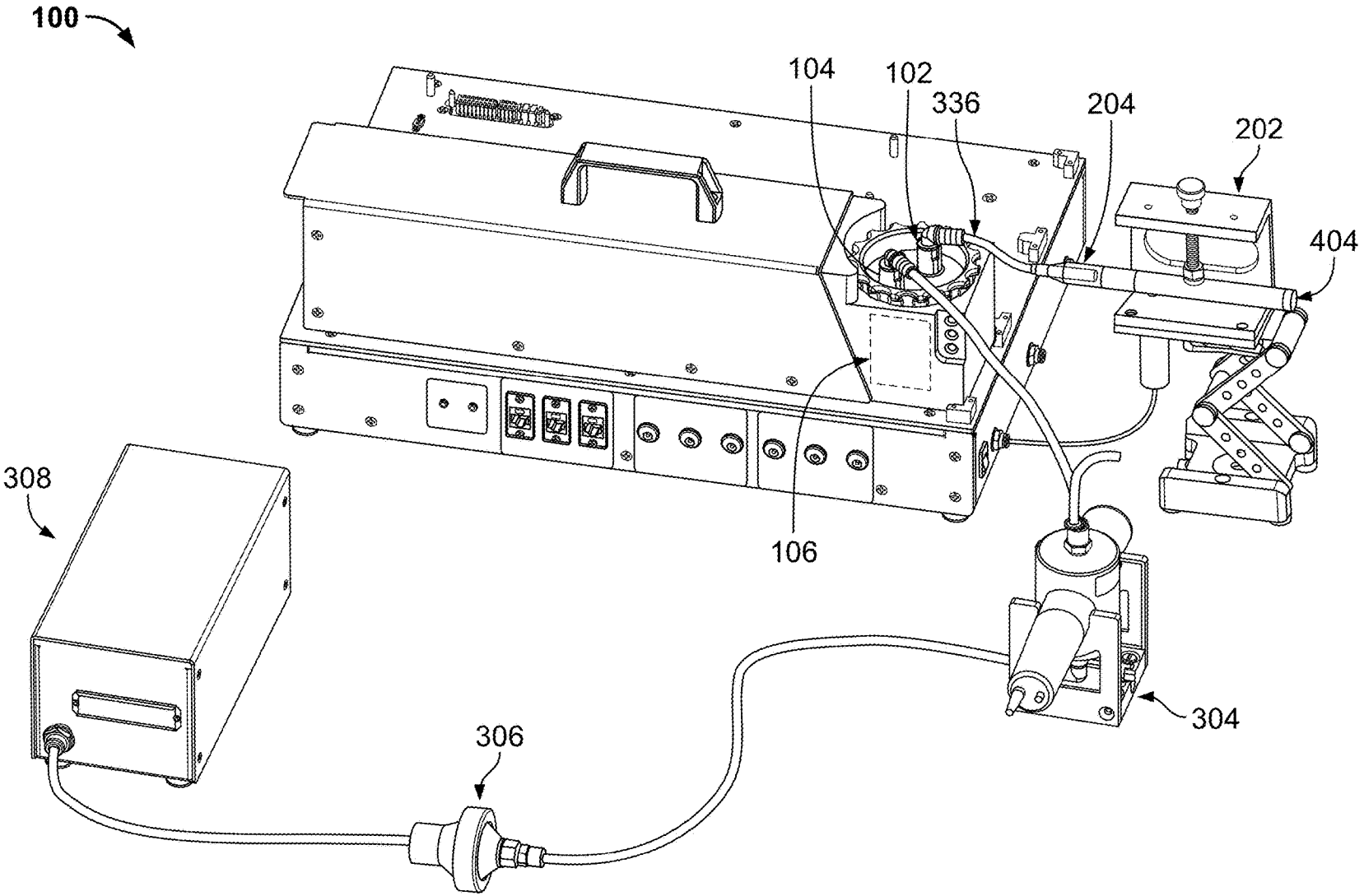

Referring now to FIGS. 2A-C, some configurations of the system 100 described throughout may be equipped to receive (and subsequently test) e-cigarette. FIG. 2A depicts the inhalation exposure system 100 configured to an e-cigarette mod 402 via a tilt platform 202. This configuration further includes the photometer 304 and the filter 306 as previously described, or may optionally include other optical sensors (e.g., optical particle counters, laser particle counters, condensation particle counters) and electrical sensors (scanning electrical mobility spectrometers, differential mobility analyzers). In this example, the filter 306 can be used for chemical composition analysis. FIG. 2B depicts an alternative configuration of the inhalation exposure system 100 with the e-cigarette mod 402 and the filter 306, wherein the filter 306 is placed along a tube 336 between the input valve 102 of the inhalation exposure system 100 and a smoking port 204 for the e-cigarette 402. This configuration is advantageous to measure a chemical composition of air immediately after it is vaped. FIG. 2C depicts the inhalation exposure system 100 configured to an e-cigarette pen 404 via the tilt platform 202, with the tube 336 being inserted into the input valve 102 and the smoking article port 204 to capture a smoking article vapor when generated by the system 100.

Figure 3A:
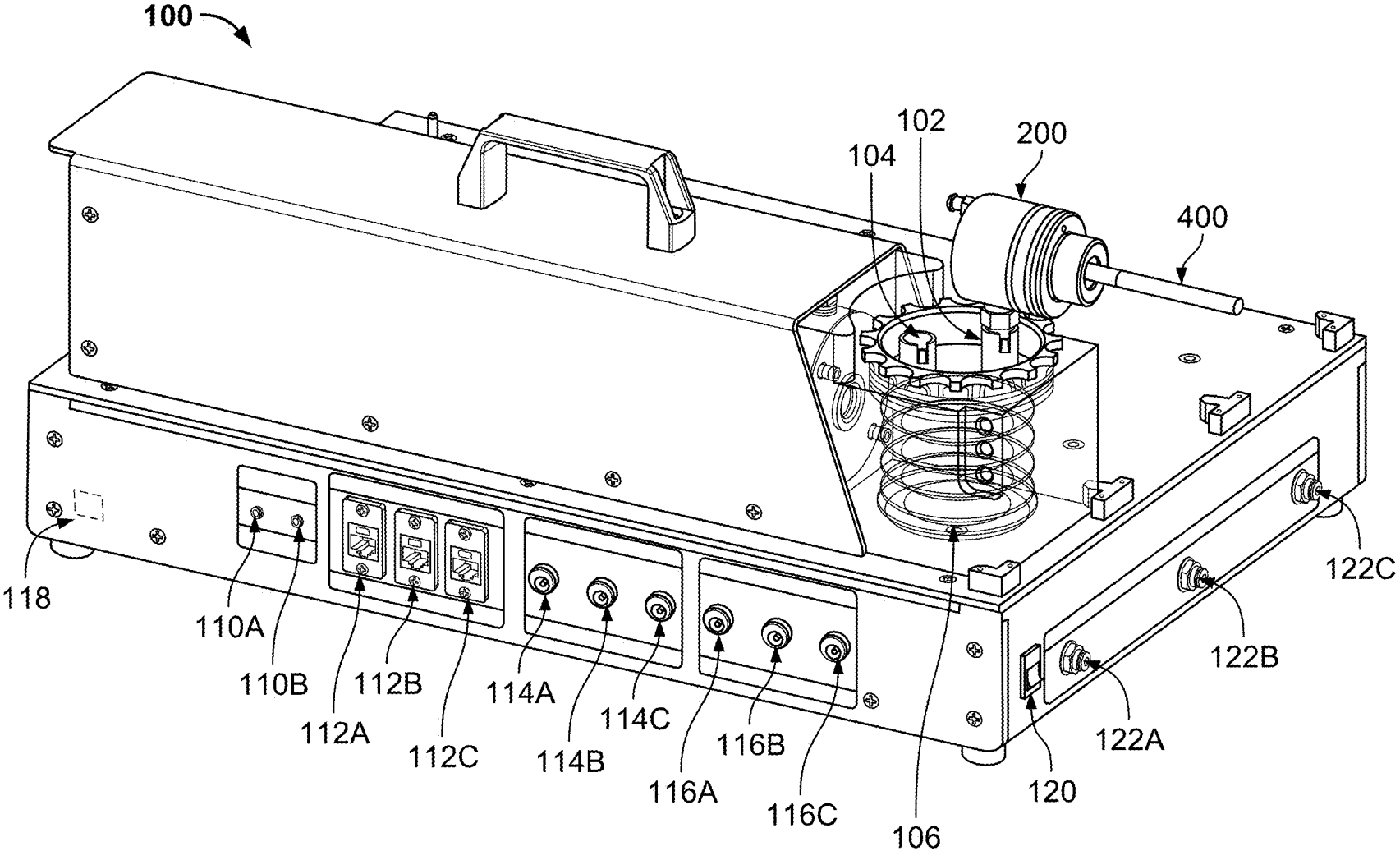
FIGS. 3A-C depict perspective views of exemplary configurations of an inhalation exposure system, in accordance with additional embodiments.
Figure 3B:
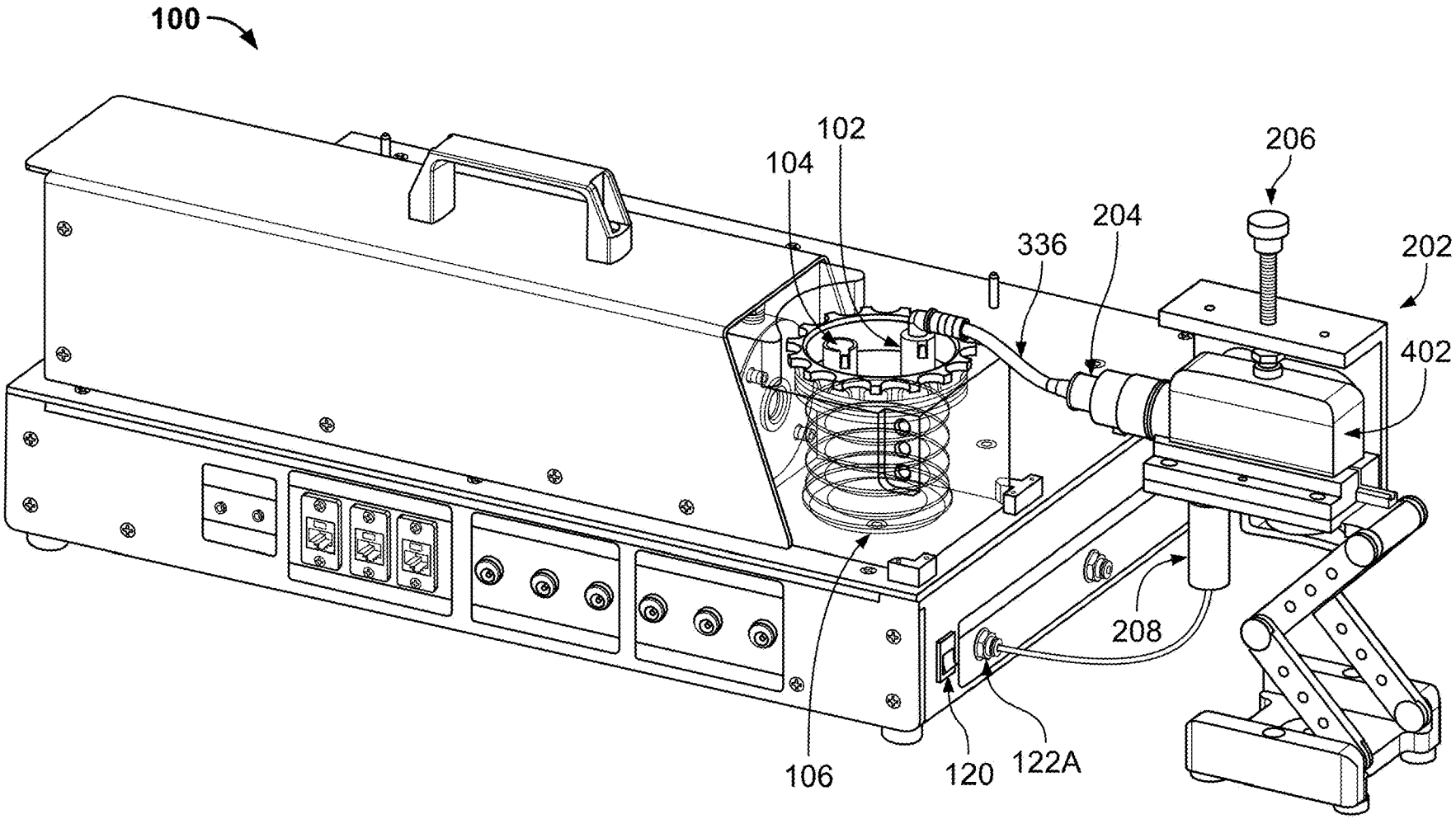
Figure 3C:
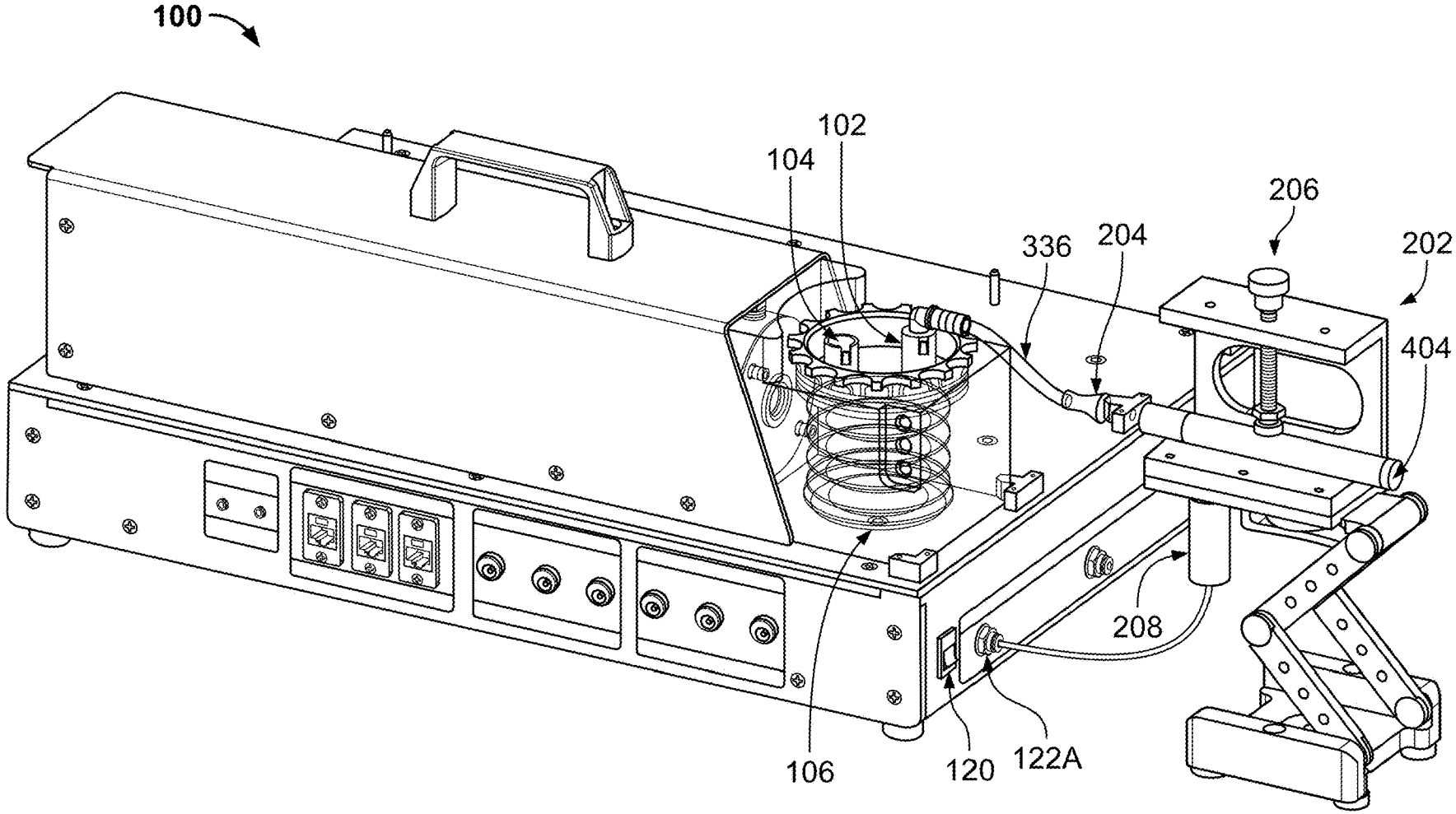

Referring now to FIGS. 3A-C, some configurations of the system 100 described throughout may be equipped with smoking article ports configured to provide for the testing of different types of smoking articles, such as cigarettes and e-cigarettes. In particular, FIG. 3A depicts the smoking article port 200 described herein (refer to FIG. 1A). This port can be advantageous for coupling the cigarette 400 (e.g., tobacco or similar traditional smoking article and a first generation e-cigarette) to the input valve 102 of the inhalation exposure system 100. The port 200 permits the capture of smoking article vapor as the cigarette 400 is smoked by the inhalation exposure system 100. The smoking article vapor is pulled in through the input valve, through the interior space along the barrier 106, as described below, and then available for testing, analysis, and/or measurement. In the example of FIG. 3A, the port 200 is a labyrinth seal, which has silicon membranes that are configured together with a foam washer. Additionally, a cover (not depicted, refer to FIGS. 6A-B) can be placed around the cigarette 400 to capture secondhand vapor. In alternative implementations (not depicted), the cigarette 400 may slide into an elbow sleeve with a silicon tube. Different smoking article ports can fit into the input valve 102 of the inhalation exposure system 100, depending on the user's testing needs and the smoking article being tested, as depicted in FIGS. 3A-C. Alternatively, in some implementations, lateral fill rubber membranes can be employed and configured to the input valve 102. A labyrinth membrane system can also be beneficial for use with different types of smoking articles, including both traditional tobacco cigarettes and e-cigarettes. As a result, the user would not need to use different attachments for testing different types of smoking articles.

FIGS. 3B-C depict the tilting platform 202 for coupling e-cigarette mods 402, e-cigarette pens 404, and other similar types of smoking articles to the input valve 102 of the inhalation exposure system 100. The tilt platform 202 can adjust to different heights and can be adjusted based on the smoking article that is being tested. A pin 206 (e.g., screw) can be used to keep the smoking article 402 or 404 in place while smoking article vapor is generated. The pin 206 can be located at a top bracket of the tilt platform 200. The pin 206 can screw down (e.g., tighten) on a surface of the smoking article 402 or 404, thereby holding the smoking article 402 or 404 in place. As depicted, the pin 206 can be long enough so that it can adjust accordingly based on the type of smoking article that is tested. Additionally, the tilt platform 202 includes a button actuator 208 (e.g., pneumatic) that can be used to begin vaping the smoking article 402 or 404.

Furthermore, as depicted in FIGS. 3A-C, the inhalation exposure system 100 includes both input and output ports for photometers (e.g., analog input) 110A and 110B respectively, inter-integrated circuits 112A-C, pumps 114A-C, and regulation controllers 116A-C for one or more pumps. The system 100 can further include a USB port 118 for wired communication with a computer system and/or the user device 310 (refer to FIG. 1A). The system 100 can further wirelessly communicate with the computer system and/or the user device 310 (e.g., BLUETOOTH, WIFI, etc.). The inhalation exposure system 100 includes a power switch 120 and high pressure pneumatic ports 122A-C (e.g., 50-100 psi) for each smoking article that is configured to the system 100. As depicted, the high pressure pneumatic port 122A is attached to the button 208 (e.g., a piston) by a high pressure line. The port 122A-C is configured to actuate the button 208 (e.g., a piston), which in turn presses a button of the smoking article 402 or 404 to activate the smoking article 402 or 404.

In the example of FIG. 3B, the user can turn on the inhalation exposure system 100 by flipping the power switch 120. The user can then begin testing/vaping the e-cigarette mod 402 once the high pressure pneumatic port 122A actuates the button 208 that is coupled to an underside of the tilt platform 200. Once the button 208 is actuated, the e-cigarette mod 402's heating element can turn on such that the e-cigarette mod 402 can generate a smoking article vapor. The Smoking article vapor can be transmitted, via the tube 336, into the input valve 102 of the inhalation exposure system 100 for testing and analysis. As described in more detail below, the vapor can flow through the interior space along the barrier 106 so as to provide some protection of components from the smoking article vapor of the smoking article 402. Alternative implementations may permit the user to start the vaping/smoking process by interacting with a user interface at the user device 310 (refer to FIG. 1A, FIGS. 8A-B). The user interface can provide the user with options to control the inhalation exposure system 100 and testing of different types of smoking articles (e.g., the cigarette 400, the e-cigarette mode 402, the e-cigarette pen 404, etc).

Figure 4:
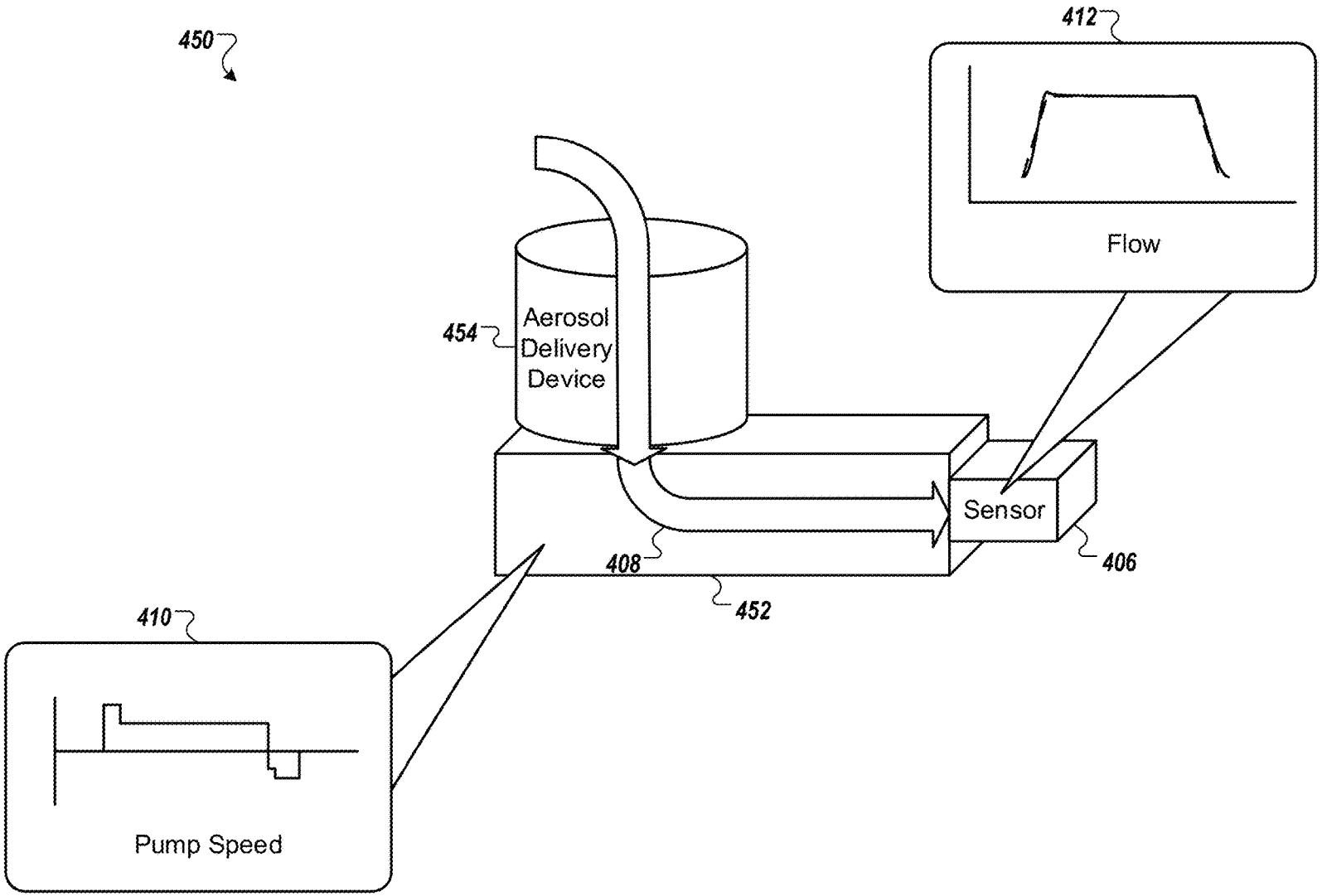
FIG. 4 shows an example system for testing inhalation exposure from an aerosol-delivery device.

Referring to FIG. 4, an example system 450 is used for testing inhalation exposure from an aerosol-delivery device. In the system 450, a testing device 452 is used to test aerosol emissions of an aerosol-delivery device 454. Example testing devices 452 can include, but are not limited to, the inhalation exposure system 100.

In the testing device 452, an aerosol-sensor 406 is positioned in a flowpath 408. The aerosol-sensor 406 includes elements that are configured to generate sensor-data based on aerosol, fluids, vapor, etc. in the flowpath 408. Example aerosol-sensors 406 can include, but are not limited to, sensors that generate electronic signals based on physical phenomena (e.g., proximity to vapor-born particles in the flowpath 408). Such aerosol-sensors 406 can include optical sensors (e.g., optical particle counters, laser particle counters, condensation particle counters) and electrical sensors (scanning electrical mobility spectrometers, differential mobility analyzers). Example aerosol-sensors 406 can include, but are not limited to, sensors that aggregate particles in the flowpath 408. Such aerosol-sensors 406 can include paper-filter collection media. Example aerosol-sensors 406 can include, but are not limited to, sensors with biological elements that may or may not react to the flowpath 408 environment. Such aerosol-sensors 406 can include cell cultures, animal models, and plant models.

The flowpath 408 can include one or more fluid pathways that allow passage of fluid past the aerosol-delivery device 454 and to the sensor 406. Example flowpaths 408 can include, but are not limited to, pipes, ducts, bellows, diaphragms, valves, plungers, etc.

Figure 5:
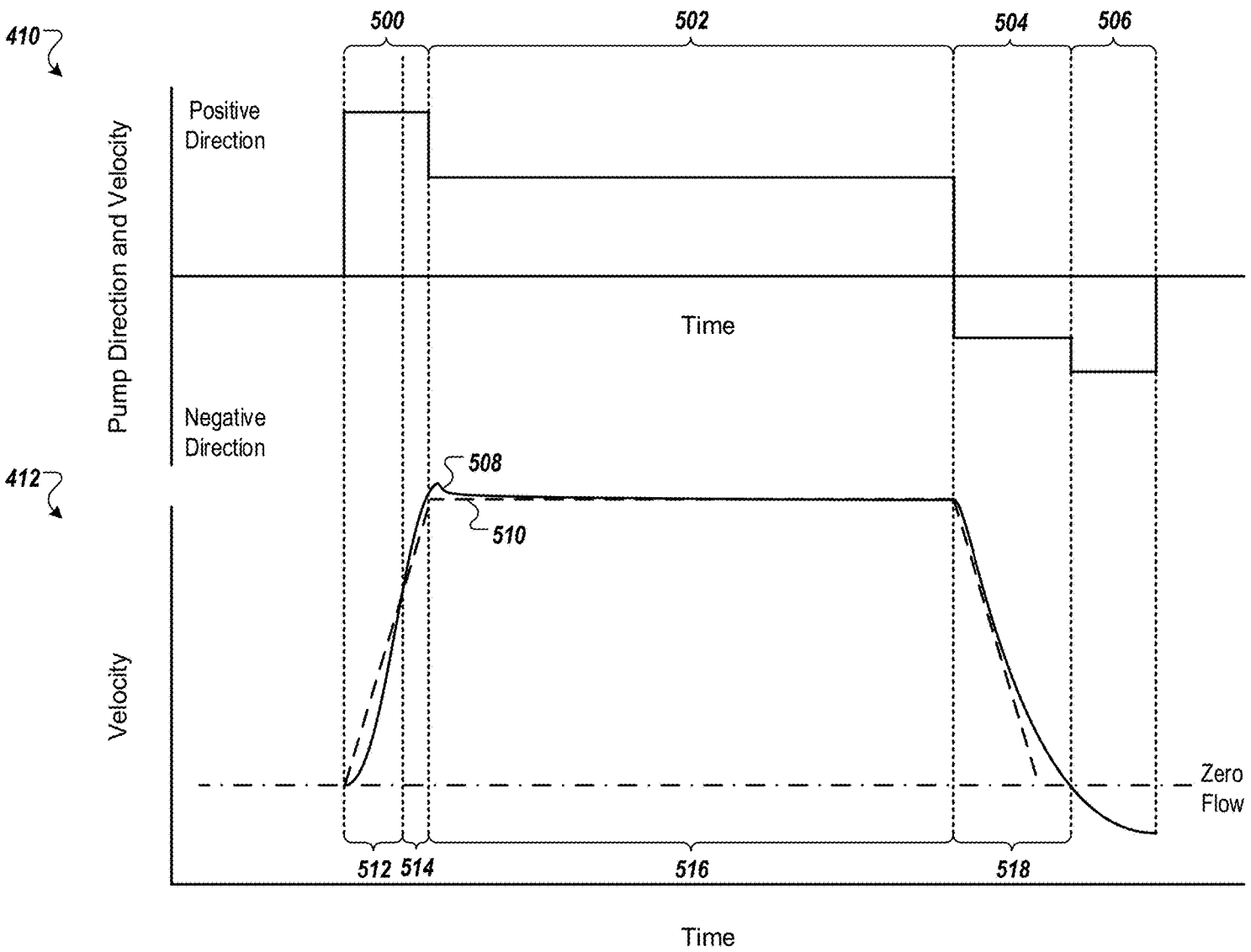
FIG. 5 shows an example flow-velocity chart with a pseudotrapezoidal flow pattern.

A pump of the testing device 452 can be driven at pump speed 410 to produce flow 412. Referring to FIG. 5, the pump speed 410 and produce flow 412 are shown in terms of velocity and time.

As shown, a pump is driven in a positive direction for a time 500 at an overshoot velocity. The pump is then driven in the positive direction for a time 502 a target velocity less than the overshoot velocity. The pump is then driven in the negative direction (the directions of some elements of the pump are reversed, some valves are actuated, etc.) for a time 504 at a reversal velocity. The pump is then driven in the negative direction (the directions of some elements of the pump are reversed, some valves are actuated, etc.) for a time 506 at a second reversal velocity. The direction and velocity shown in pump speed 410 are shown with strict and abrupt transitions. A person having ordinary skill in the art will understand that such strict and abrupt transitions may be implemented as instructions to a pump that begin and end at full speed, but a physical pump, having mass and therefore inertia, may actually actuate with more pseudorectanguar transitions than what is shown.

As a result of the pump speed 410, the testing device 452 can pass fluid through the flowpath 408 at with a pseudotrapezoidal flow profile 508 that approaches a strict trapezoidal flow profile 510. As shown here, the pseudotrapezoidal flow profile 508 is shown with a solid line, while the strict trapezoidal flow profile 510 is shown with a dashed line.

In the pseudotrapezoidal flow profile 508, the velocity increases slower than the increase in speed of the strict trapezoidal flow profile 510 in time 512, crossing the strict trapezoidal flow profile 510 at the end of time 512 and the beginning of a time 514.

In a time 516, the pseudotrapezoidal flow profile 508 begins above the strict trapezoidal flow profile 510 and approaches (e.g., asymptotically, non-asymptotically) or meets the strict trapezoidal flow profile 510 at the target velocity. In a time 518, the pseudotrapezoidal flow profile 508 approaches or reaches the base velocity (e.g., a zero or non-zero velocity) slower than the strict trapezoidal flow profile 510. In a time 520, a negative flow (i.e. in the opposite direction as in times 512-518) is created.

In this way, pump velocity 410 can produce a flow 412 that is near enough a strict trapezoidal shape to be useful for various technological purposes. For example, a testing protocol may call for a flow profile that matches a strict trapezoidal shape within a particular margin of error, and the pseudotrapezoidal flow profile 508 may meet such criteria.

As will be understood, the values of velocity, force, time, etc. used may depend on the particular physical properties of the machinery to be controlled. In some cases, mathematical derivations may be used to design these parameters. In some cases, trial-and-error may be used to design these parameters. In some cases, mathematical derivations may be generated as initial test-values, which can be further refined. For example, with a set of initial test values, a sensor (e.g., a flow sensor, a mass-flow sensor, or the like) may be used to measure the mass, flow, or other property of the fluid upstream, downstream, or otherwise around the test article. With such sensing, the initial values may be refined to produce the flow required or desired.

Figure 6A:
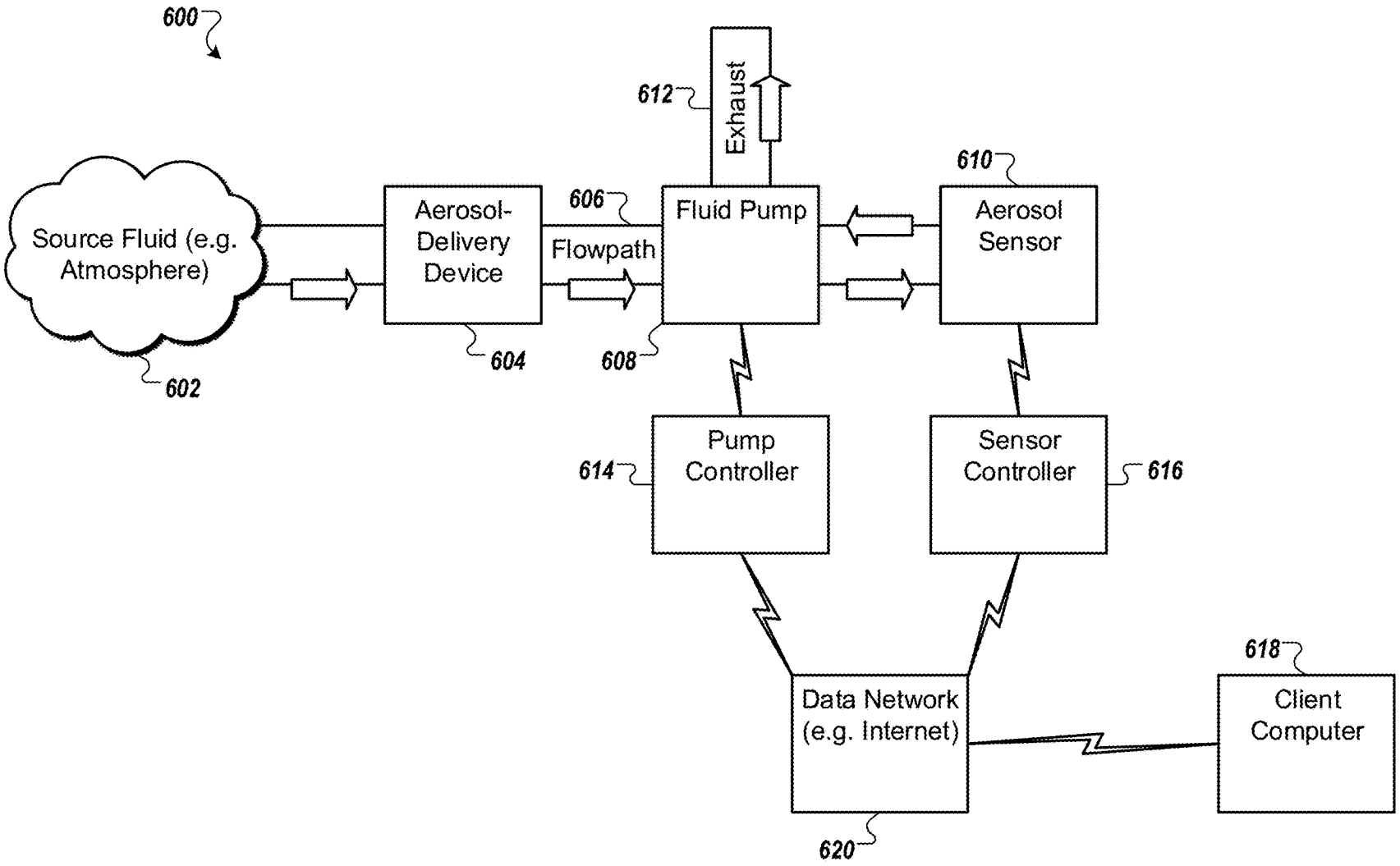
FIGS. 6A and 6B shows an example aerosol emission testing system.
Figure 6B:
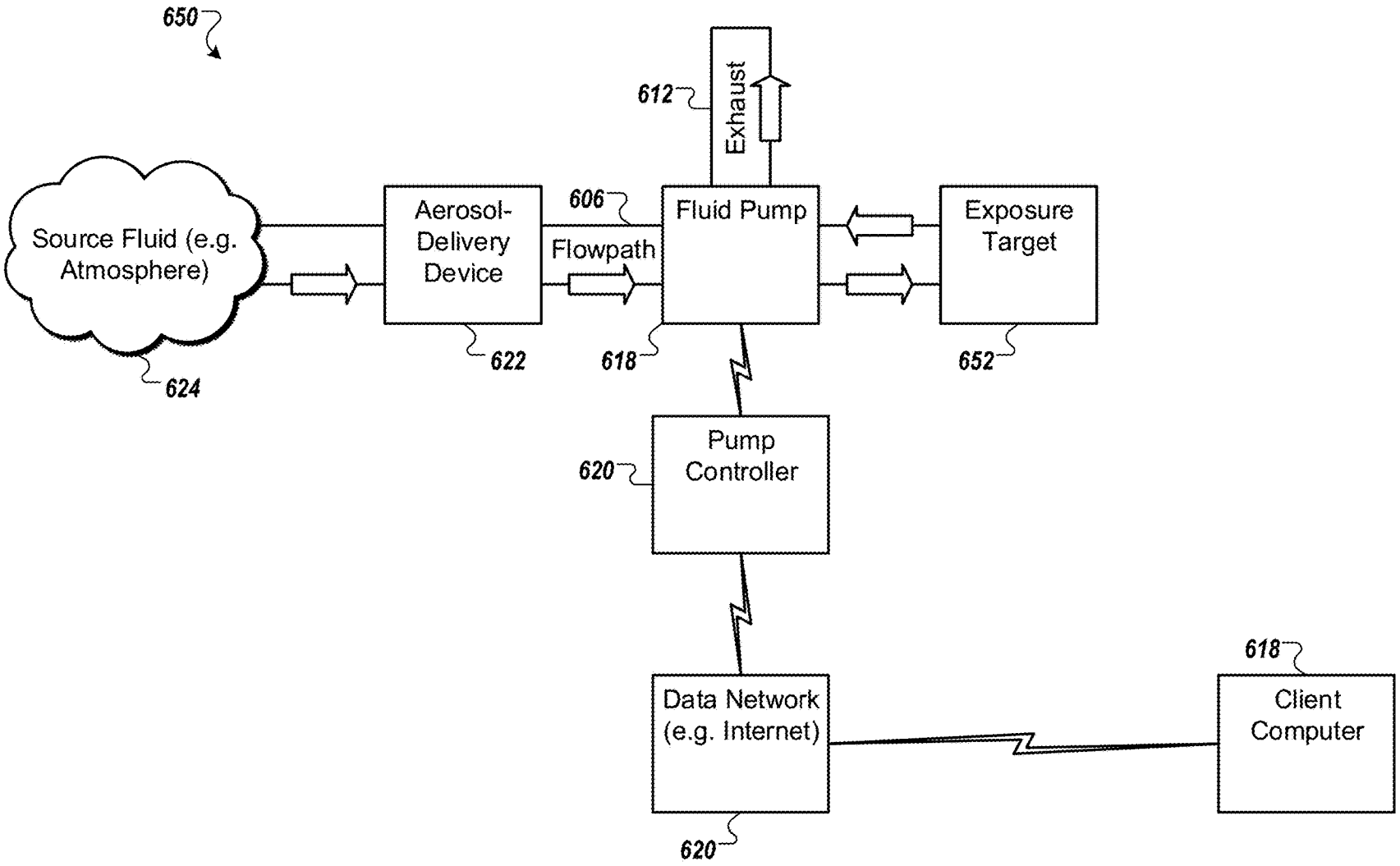

Referring to FIG. 6A, an example system 600 is used for aerosol emission testing. In the system 600, a source fluid 602 is provided to the system 600. The source fluid 602 is a fluid technologically capable of carrying an aerosol from an aerosol-delivery device 604. Examples of source fluid include, but are not limited to, ambient atmosphere, an inert gas reserve, a temperature controlled gas, or a liquid fluid.

The aerosol-delivery device 604 contains one or more components capable of delivering an aerosol into a fluid from the fluid source 602 that has been drawn into a flowpath 606. Example aerosol-delivery devices 604 can include, but are not limited to, cigarettes, electronic cigarettes, vaping devices including those intended for human inhalation, fluid nebulizers including those intended for human inhalation, and reaction chambers containing a chemical reaction that produces an aerosol.

A fluid pump 608 is connected to the flowpath 606 and is capable of drawing fluid from the fluid source 602, past the aerosol delivery device 604, and toward an aerosol sensor 610. In addition, the fluid pump 608 is connected to an exhaust 612 and is capable of drawing fluid from the aerosol sensor 610 and out the exhaust 612 where the fluid can be exhausted to, for example, the source fluid 602 (e.g., the atmosphere), into a collection or sequestration chamber (not shown), or another target.

In order to perform these actions, the fluid pump 608 can operate in two or more modes of operation. In one example, the fluid pump 608 can operate in a first mode of operation to draw fluid from the source fluid 602, through the aerosol-delivery device 604, and to the aerosol sensor 610. In this example, in a second mode of operation, the fluid pump 608 can operate to draw fluid from the aerosol sensor 610 and out the exhaust. In this example, the fluid pump 608 is incapable of performing the actions of the first operation while in the second mode of operation and is incapable of performing the actions of the second operation while in the first mode of operation. In another example, the fluid pump 608 (or, e.g., two fluid pumps) is capable of simultaneously drawing fluid from the fluid source 602 and drawing fluid from the aerosol sensor 610. In yet another example, the exhaust 612 can be connected directly to the aerosol sensor 610 and the fluid pump 608, operating only in a single mode, can draw fluid from the fluid source 602 and deliver the fluid past the aerosol sensor 610 to the exhaust 612 by pumping in a single direction.

The fluid pump 608 can be communicably coupled to a pump controller 614. The pump controller 614 can include one or more processors and computer memory that stores instructions for the pump controller 614. The pump controller 614 can be configured to issue commands to the fluid pump 608 to drive the fluid pump 608 and/or to receive data from the fluid pump 608. An example of such a communication may be a data message with a command to drive the fluid pump 608 in a particular mode, for a particular time, at a particular velocity.

The aerosol sensor 610 can be communicably coupled to a sensor controller 616. The sensor controller 616 can include one or more processors and computer memory that stores instructions for the sensor controller 616. The sensor controller 616 can be configured to issue commands to the aerosol sensor 610 to sample the fluid in the flowpath 606 and/or to receive data from the aerosol sensor 610. An example of such data from the aerosol sensor 610 can include sensor readings. In some cases, the sensor readings may be converted (e.g., from an alternating current to a digital current format), aggregated (multiple readings from one event formatted in a list), normalized (e.g., weighted to ensure reading values are between 0 and 1), etc. by the aerosol sensor 610.

The pump controller 614, sensor controller 616, one or more client computers 618, and other components can be communicably coupled with a data network 620. The data network may be or include local area networks, wide area networks, the Internet, etc.

The client computer 618 can include one or more processors and computer memory that stores instructions for the client computer 618. The client computer 618 may be issue commands to the pump controller 614 and/or sensor controller in order to engage the system 600 to generate data, and the client computer 618 can collect, store, and report that data. For example, the client computer 618 may issue a command to collect five exposures with system 600, receive four readings, and store those four readings to memory. Then, when requested, the client computer 618 can provide those four readings in a report to a requesting element (not shown) such as a human user another computer device.

Referring to FIG. 6A, an example system 650 is used for aerosol emission testing. In the system 650, an exposure target 652 is exposed to the aerosol of the aerosol-delivery device 604. The exposure target 652 contains one or more elements that can be examined after exposure to the aerosol of the aerosol-delivery device 604. For example, the exposure target 652 can contain a filter for depositing aerosol on, a cell culture that can be examined after exposure, animal subjects or plant subjects that can be studied after exposure, etc. Different types of target may require different structures in the exposure target 652. For example, spring-clips or a wire hangar may be used to hold a filter, while a glass dish may be used to hold a cell culture.

Figure 7:
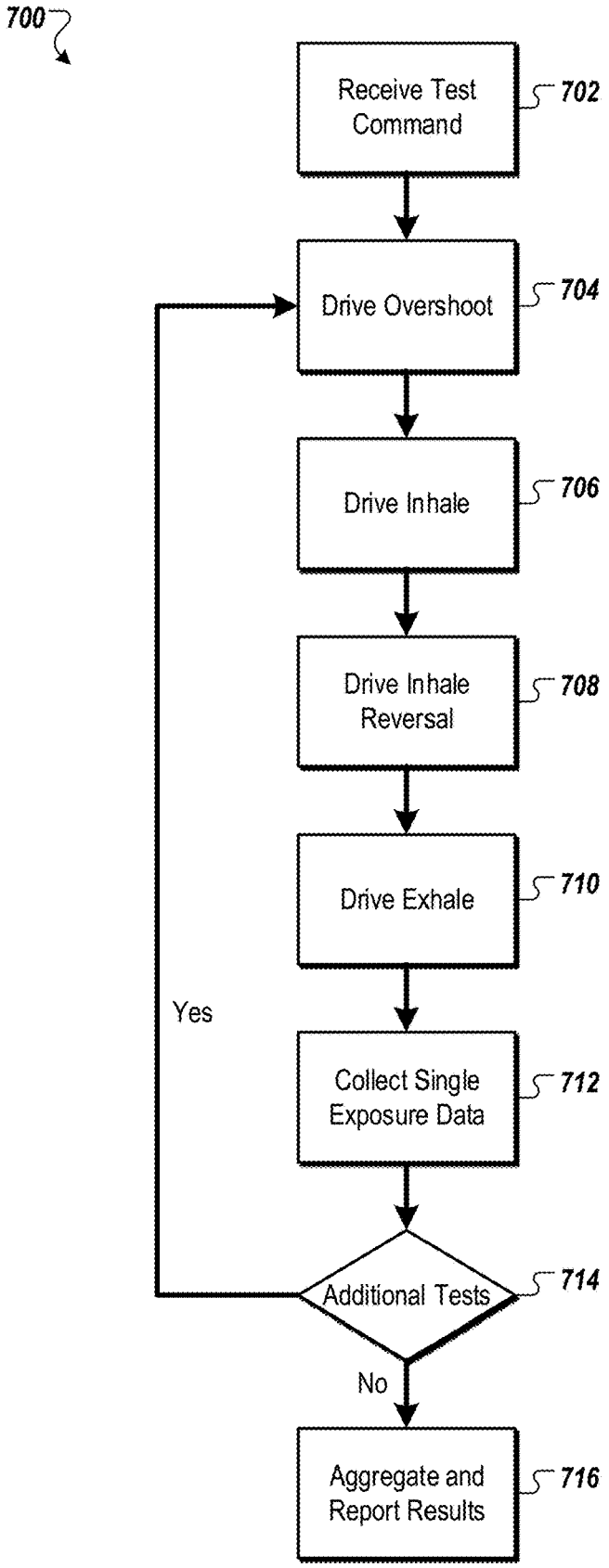
FIG. 7 shows a flowchart of an example process for testing aerosol emissions of an aerosol-delivery device.

Referring to FIG. 7, a process 700 test aerosol emissions of an aerosol-delivery device, which can include transferring a smoking article vapor through an inhalation exposure system, the system comprising. The process 700 can be used by, for example, the system 600. Therefore, the following description will be made with reference to the system 600. However, other systems may be used to perform the process 700 or similar processes.

A test command is received 702. For example, the client computer 618 can generate an order to sense aerosol-delivery of three simulated inhalations characterized by a flow profile with a strict trapezoid having an error range. The client computer 618 can transmit this command to the pump controller 614 and/or the sensor controller 616. In response, the pump controller 614 can prepare to instruct the fluid pump 608 to actuate with a pseudotrapezoidal flow profile and the sensor controller 616 can prepare to capture sensor data of the event.

A fluid pump is driven in a first direction for a first time at an overshoot velocity 704. For example, the pump controller 614 can issue a first command to the fluid pump 608, the first command including parameters specifying the first time in, e.g., milliseconds and the velocity in, e.g., motor rotations per second. In response to receiving the first command, the fluid pump 608 can engage with the velocity shown in time 500.

The fluid pump is driven in the first direction for a second time after the first time at a target velocity less than the overshoot velocity 706. For example, the pump controller 614 can issue a second command to the fluid pump 608, the second command including parameters specifying the second time in, e.g., milliseconds and the velocity in, e.g., motor rotations per second. In response to receiving the second command, the fluid pump 608 can engage with the velocity shown in the time 502.

The fluid pump is driven in a second direction for a third time after the second time at a reversal velocity 708. For example, the pump controller 614 can issue a third command to the fluid pump 608, the third command including parameters specifying the third time in, e.g., milliseconds and the velocity in, e.g., motor rotations per second. In response to receiving the third command, the fluid pump 608 can engage with the velocity shown in the time 504.

The fluid pump is driven for a fourth time in the second direction after the third time at a second reversal velocity less than the reversal velocity 710. For example, the pump controller 614 can issue a fourth command to the fluid pump 608, the fourth command including parameters specifying the fourth time in, e.g., milliseconds and the velocity in, e.g., motor rotations per second. In response to receiving the fourth command, the fluid pump 608 can engage with the velocity shown in the time 506.

Data of a single exposure is collected 712. For example, the sensor controller 616 can energize an element of the aerosol sensor 610 with an alternating current and receive back the alternating current that has been modulated based on exposure to the aerosol in the fluid. An alternating-current-to-direct-current (A to D) converter in the sensor controller 616 can then convert the modulated alternating current to a direct current and then convert the direct current to one or more digital values. In doing so, the sensor controller 616 is generating a digital value that reflects one or more features of the aerosol.

If additional tests are called for in the received test command 714, elements 704-512 can be repeated. For example, as the order specified three simulated inhalations, the elements 704-512 can be performed two more times, for a total of three times.

If additional tests are called for in the received test command 714, results are aggregated and reported 716. For example, with three simulated inhalations are completed, the sensor controller 616 can aggregate and report the sensed values to the client computer 618.

Figure 8A:
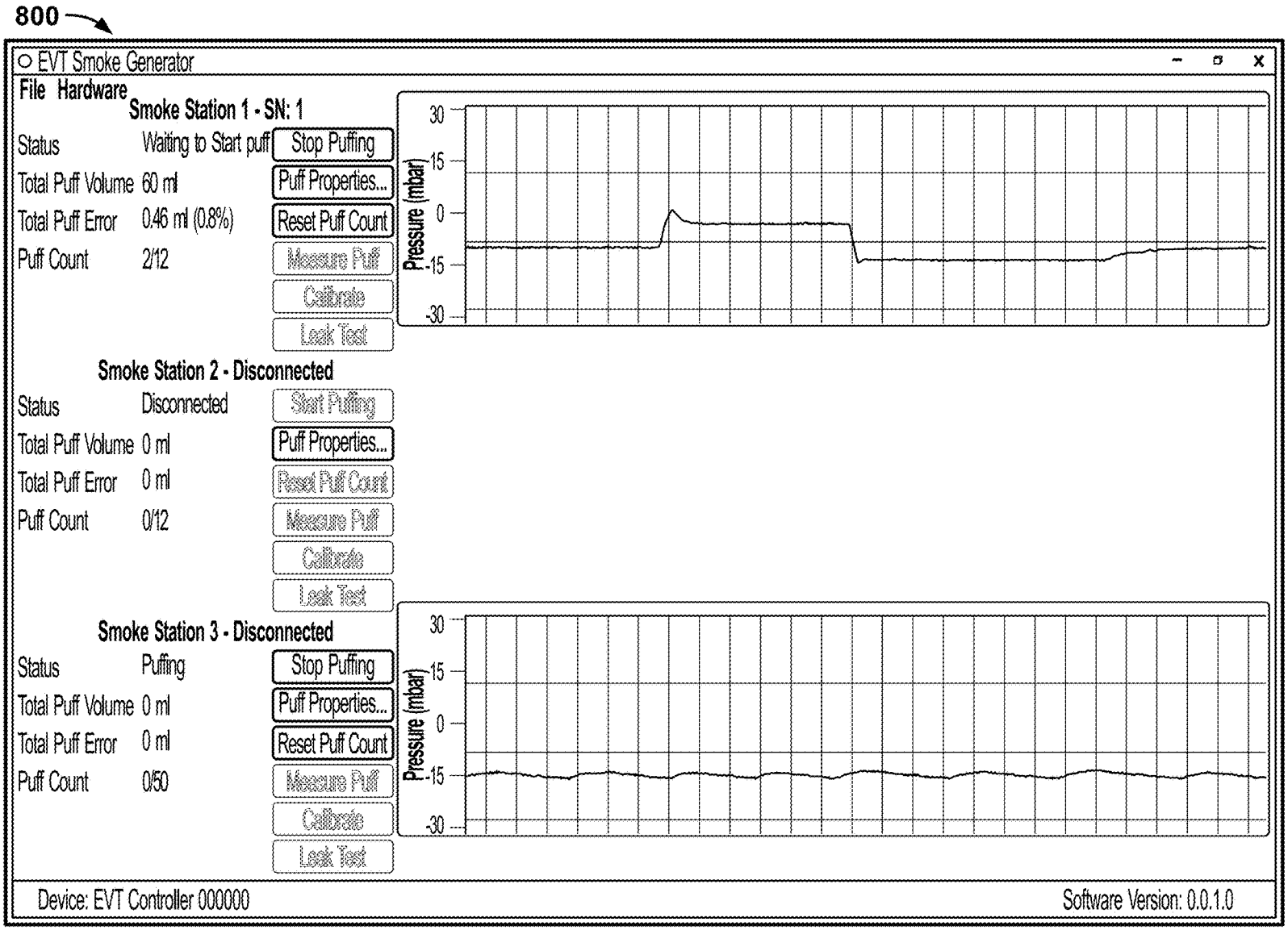
FIGS. 8A-B depict exemplary graphical user interfaces of the inhalation exposure system from any of the embodiments of FIGS. 1A-G, 2A-C, and 3A-C.
Figure 8B:
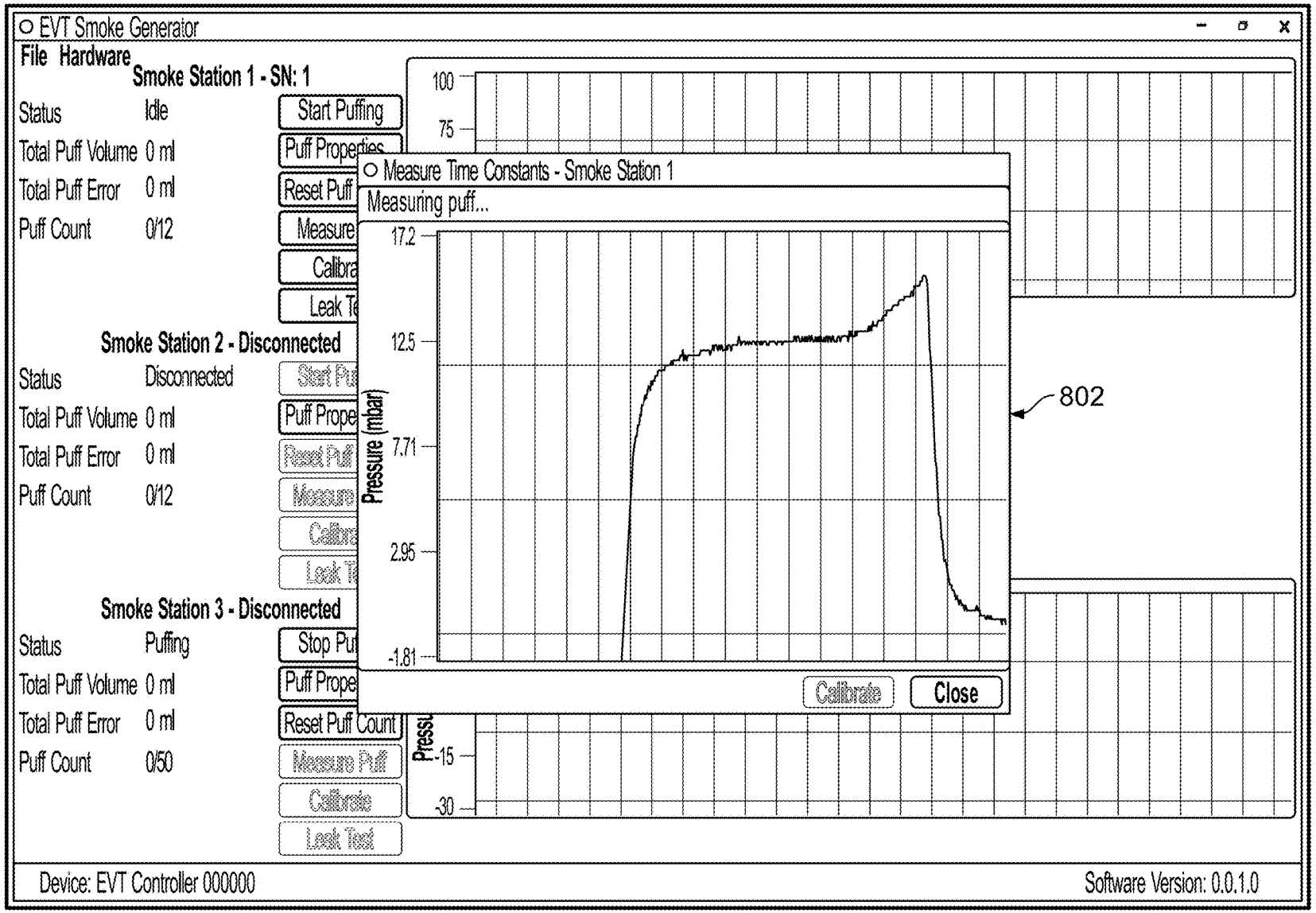

Referring now to FIGS. 8A-B, the user can control the inhalation exposure system 100 from a computer and/or the user device 310 (refer to FIG. 1A) that is in communication (e.g., wired and/or wireless) with the inhalation exposure system 100. A graphical user interface (UI) 800 can present information to the user at the user device 310. Using the UI 800, the user can select a particular station that is connected to the inhalation exposure system 100 for testing. For example, if four plethysmography chambers are connected to the inhalation exposure system 100, the user can monitor and/or modify properties associated with any one of those chambers via the UI 800. The user can select what type(s) of smoking article is used for testing. Based on that selection, a profile for each station and/or barrier (e.g., the barrier 106 described herein) can be adjusted accordingly. The adjustments to each profile can be based on user-inputted information and/or information stored by the input device 310 (e.g., presets). The user can chose to apply standard puffs and/or modify the puffs, such as changing a puff frequency and/or a puff volume. The user can also use the UI 800 to perform a leak test, which determines whether the barrier 106 was placed correctly within the smoke chamber 128 and/or whether the smoking article is correctly affixed to the smoking article port. The leak test more generally ensures that there is no leakage or air from any of the valves and components used in the inhalation exposure system 100.

Still referring to FIG. 8A, the user can select an option/press a button to start puffing (e.g., turn on/actuate the inhalation exposure system 100 and/or the differential pressure generator). The inhalation exposure system 100 can perform as many puffs as the user manually selects. Alternatively, the system 100 can perform a predetermined number of puffs based on the user's selection of the type of smoking article and/or other characteristics. The user can also couple a mass flow sensor to the inhalation exposure system 100 and use the UI 800 to view data sensed in real-time. The user can then compare mass flow volumes before and after a smoking article is tested. In some implementations, the mass flow sensor can be coupled to an end of a smoking article (e.g., a butt of a cigarette and/or e-cigarette). In other implementations, the mass flow sensor can be coupled to a tube that encompasses the smoking article (e.g., refer to FIG. 2B).

While the inhalation exposure system 100 puffs the smoking article, information can be transmitted in real-time to the user device 310. That information can be displayed at the UI 800. For example, as depicted in FIGS. 8A-B, a pressure wave forms in real-time at the UI 800 as the device puffs the smoking article. The pressure wave that is graphically depicted can be proportional to a flow through the smoking article that can be based on a resistance of the smoking article.

Referring back to FIG. 8A, the UI 800 depicts each smoke station and its associated properties and data. For example, smoke station 1 is connected to the inhalation exposure system 100 and is in communication with the user device 310. Smoke station 1 refers to a pressure measurement off the piston, which is used to actuate the inhalation exposure system 100 and generate the differential pressure, as previously described. A pressure sensor can be positioned between a head of the piston and the barrier 106 (e.g., bellow) such that real-time pressure measurements can be made and transmitted to the user device 310. Additionally, if a photometer is used (refer to FIG. 1A), particle concentrations can be monitored and collected in real-time. The photometer data can be displayed in a plot/graph like the pressure wave form depicted in FIG. 8A. Additionally, each station has a "status," "total puff volume," "total puff error," and "puff count." This information is updated in real-time as the user controls the inhalation exposure system 100 and/or the system 100 is generally actuated (e.g., puffing the smoking article). In some implementations, different information can be listed and associated with each station.

Still referring to FIG. 8A, the user has several options (e.g., buttons) with regards to controlling each smoke station independently of each other. The user can start and stop puffing, change one or more of the puff properties, reset a puff count, measure a puff, calibrate, and/or perform a leak test. Upon selecting the option/button for puff properties, the user can modify a puff volume, frequency, number of puffs, puffs per minute, inhalation properties, exhalation properties, as well as select what type of smoking article is being used (e.g., cigarette, e-cigarette, etc.). Upon selecting the option/button to measure a puff, a graph/plot like the pressure wave plot can be produced as a pop-up window 802 (refer to FIG. 8B). The new plot for measuring puff can be made using data collected in real-time from a mass flow sensor that is attached to the inhalation exposure system 100. Additional and/or alternative sensors can be used, such as a pressure sensor and/or a photometer, as described throughout this disclosure. In some implementations, temperature and/or humidity sensors can be used and coupled with a heat output. The temperature and/or humidity sensors can be configured to regulate a temperature and/or humidity of a flow path.

Figure 9:
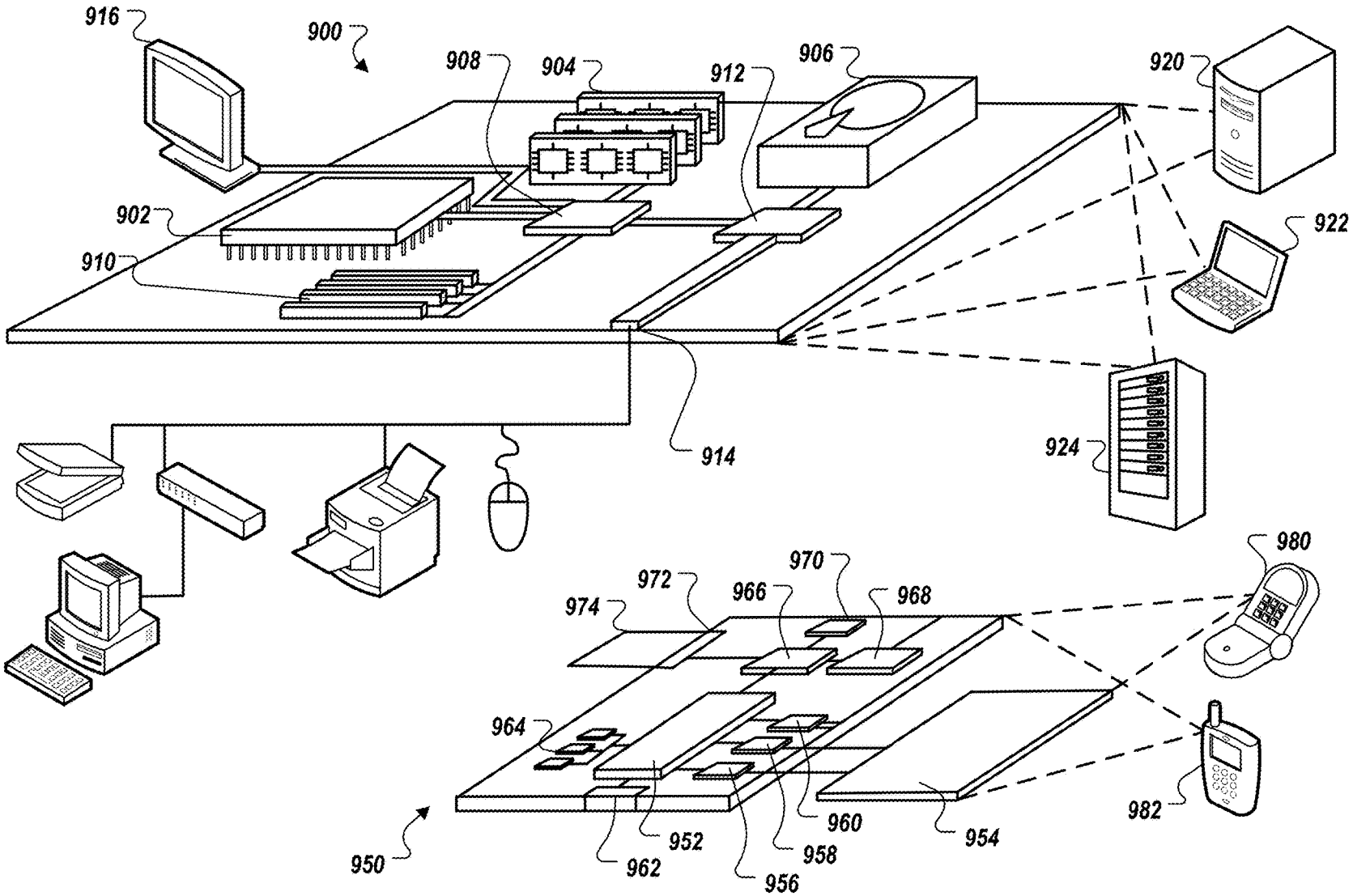
FIG. 9 is a schematic diagram that shows an example of a computing device and a mobile computing device. Like reference symbols in the various drawings indicate like elements

As mentioned, the UI 800 can also display a pressure wave (refer to FIG. 8A) for each of the smoke stations that are connected to the inhalation exposure system 100. The pressure wave can be updated in real-time. Each smoke station can be controlled independently of the other. As a result, the user can perform different tests and/or the same test but with different properties and/or conditions per stations. Referring to FIG. 9 a computing device 900 and an example of a mobile computing device can be used to implement the techniques described here. The computing device 900 is intended to represent various forms of digital computers, such as laptops, desktops, workstations, personal digital assistants, servers, blade servers, mainframes, and other appropriate computers. The mobile computing device is intended to represent various forms of mobile devices, such as personal digital assistants, cellular telephones, smart-phones, and other similar computing devices. The components shown here, their connections and relationships, and their functions, are meant to be exemplary only, and are not meant to limit implementations of the inventions described and/or claimed in this document.

The computing device 900 includes a processor 902, a memory 904, a storage device 906, a high-speed interface 908 connecting to the memory 904 and multiple high-speed expansion ports 910, and a low-speed interface 912 connecting to a low-speed expansion port 914 and the storage device 906. Each of the processor 902, the memory 904, the storage device 906, the high-speed interface 908, the high-speed expansion ports 910, and the low-speed interface 912, are interconnected using various busses, and can be mounted on a common motherboard or in other manners as appropriate. The processor 902 can process instructions for execution within the computing device 900, including instructions stored in the memory 904 or on the storage device 906 to display graphical information for a GUI on an external input/output device, such as a display 916 coupled to the high-speed interface 908. In other implementations, multiple processors and/or multiple buses can be used, as appropriate, along with multiple memories and types of memory. Also, multiple computing devices can be connected, with each device providing portions of the necessary operations (e.g., as a server bank, a group of blade servers, or a multi-processor system).

The memory 904 stores information within the computing device 900. In some implementations, the memory 904 is a volatile memory unit or units. In some implementations, the memory 904 is a non-volatile memory unit or units. The memory 904 can also be another form of computer-readable medium, such as a magnetic or optical disk.

The storage device 906 is capable of providing mass storage for the computing device 900. In some implementations, the storage device 906 can be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product can also contain instructions that, when executed, perform one or more methods, such as those described above. The computer program product can also be tangibly embodied in a computer- or machine-readable medium, such as the memory 904, the storage device 906, or memory on the processor 902.

The high-speed interface 908 manages bandwidth-intensive operations for the computing device 900, while the low-speed interface 912 manages lower bandwidth-intensive operations. Such allocation of functions is exemplary only. In some implementations, the high-speed interface 908 is coupled to the memory 904, the display 916 (e.g., through a graphics processor or accelerator), and to the high-speed expansion ports 910, which can accept various expansion cards (not shown). In the implementation, the low-speed interface 912 is coupled to the storage device 906 and the low-speed expansion port 914. The low-speed expansion port 914, which can include various communication ports (e.g., USB, Bluetooth, Ethernet, wireless Ethernet) can be coupled to one or more input/output devices, such as a keyboard, a pointing device, a scanner, or a networking device such as a switch or router, e.g., through a network adapter.

The computing device 900 can be implemented in a number of different forms, as shown in the figure. For example, it can be implemented as a standard server 920, or multiple times in a group of such servers. In addition, it can be implemented in a personal computer such as a laptop computer 922. It can also be implemented as part of a rack server system 924. Alternatively, components from the computing device 900 can be combined with other components in a mobile device (not shown), such as a mobile computing device 950. Each of such devices can contain one or more of the computing device 900 and the mobile computing device 950, and an entire system can be made up of multiple computing devices communicating with each other.

The mobile computing device 950 includes a processor 952, a memory 964, an input/output device such as a display 954, a communication interface 966, and a transceiver 968, among other components. The mobile computing device 950 can also be provided with a storage device, such as a micro-drive or other device, to provide additional storage. Each of the processor 952, the memory 964, the display 954, the communication interface 966, and the transceiver 968, are interconnected using various buses, and several of the components can be mounted on a common motherboard or in other manners as appropriate.

The processor 952 can execute instructions within the mobile computing device 950, including instructions stored in the memory 964. The processor 952 can be implemented as a chipset of chips that include separate and multiple analog and digital processors. The processor 952 can provide, for example, for coordination of the other components of the mobile computing device 950, such as control of user interfaces, applications run by the mobile computing device 950, and wireless communication by the mobile computing device 950.

The processor 952 can communicate with a user through a control interface 958 and a display interface 956 coupled to the display 954. The display 954 can be, for example, a TFT (Thin-Film-Transistor Liquid Crystal Display) display or an OLED (Organic Light Emitting Diode) display, or other appropriate display technology. The display interface 956 can comprise appropriate circuitry for driving the display 954 to present graphical and other information to a user. The control interface 958 can receive commands from a user and convert them for submission to the processor 952. In addition, an external interface 962 can provide communication with the processor 952, so as to enable near area communication of the mobile computing device 950 with other devices. The external interface 962 can provide, for example, for wired communication in some implementations, or for wireless communication in other implementations, and multiple interfaces can also be used.

The memory 964 stores information within the mobile computing device 950. The memory 964 can be implemented as one or more of a computer-readable medium or media, a volatile memory unit or units, or a non-volatile memory unit or units. An expansion memory 974 can also be provided and connected to the mobile computing device 950 through an expansion interface 972, which can include, for example, a SIMM (Single In Line Memory Module) card interface. The expansion memory 974 can provide extra storage space for the mobile computing device 950, or can also store applications or other information for the mobile computing device 950. Specifically, the expansion memory 974 can include instructions to carry out or supplement the processes described above, and can include secure information also. Thus, for example, the expansion memory 974 can be provide as a security module for the mobile computing device 950, and can be programmed with instructions that permit secure use of the mobile computing device 950. In addition, secure applications can be provided via the SIMM cards, along with additional information, such as placing identifying information on the SIMM card in a non-hackable manner.

The memory can include, for example, flash memory and/or NVRAM memory (non-volatile random access memory), as discussed below. In some implementations, a computer program product is tangibly embodied in an information carrier. The computer program product contains instructions that, when executed, perform one or more methods, such as those described above. The computer program product can be a computer- or machine-readable medium, such as the memory 964, the expansion memory 974, or memory on the processor 952. In some implementations, the computer program product can be received in a propagated signal, for example, over the transceiver 968 or the external interface 962.

The mobile computing device 950 can communicate wirelessly through the communication interface 966, which can include digital signal processing circuitry where necessary. The communication interface 966 can provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication can occur, for example, through the transceiver 968 using a radio-frequency. In addition, short-range communication can occur, such as using a Bluetooth, WiFi, or other such transceiver (not shown). In addition, a GPS (Global Positioning System) receiver module 970 can provide additional navigation- and location-related wireless data to the mobile computing device 950, which can be used as appropriate by applications running on the mobile computing device 950.

The mobile computing device 950 can also communicate audibly using an audio codec 960, which can receive spoken information from a user and convert it to usable digital information. The audio codec 960 can likewise generate audible sound for a user, such as through a speaker, e.g., in a handset of the mobile computing device 950. Such sound can include sound from voice telephone calls, can include recorded sound (e.g., voice messages, music files, etc.) and can also include sound generated by applications operating on the mobile computing device 950.

The mobile computing device 950 can be implemented in a number of different forms, as shown in the figure. For example, it can be implemented as a cellular telephone 980. It can also be implemented as part of a smart-phone 982, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

What is claimed is:

1. A system comprising:

an aerosol-sensor positioned in a flowpath;

a fluid pump capable of producing a flow of smoking article vapor, at a variable velocity, along the flowpath to the aerosol-sensor;

a pump controller communicably coupled to the pump and comprising a processor;

computer memory storing instructions that, when executed by the processor, cause the pump controller to perform operations comprising:

activate the fluid pump in a first direction for a first time at an overshoot velocity;

activate the fluid pump in the first direction for a second time after the first time at a target velocity less than the overshoot velocity;

activate the fluid pump in a second direction for a third time after the second time at a reversal velocity; and activate the fluid pump for a fourth time in the second direction after the third time at a second reversal velocity less than the reversal velocity.

2. The system of claim 1, wherein the reversal velocity is greater than the target velocity.

3. The system of claim 1, wherein the operations cause the fluid in the flowpath to flow faster than the target velocity for a first duration, and then return to the target velocity for a second duration.

4. The system of claim 3, wherein the second duration is more than five times the first duration.

5. The system of claim 1, wherein the operations cause the fluid to flow along the flowpath with a velocity characterized by a pseudotrapezoidal flow pattern, the pseudotrapezoidal flow pattern having a period of greater-than-target velocity.

6. The system of claim 1, wherein the system further comprises a sensor-controller communicably coupled to the aerosol-sensor and configured to generate a reading from the aerosol-sensor.

7. A system comprising:

a processor; and computer memory storing instructions that, when executed by the processor, cause the processor to perform operations comprising:

activate a fluid pump, in a first direction for a first time at an overshoot velocity, wherein the fluid pump is capable of pumping aerosol emissions of an aerosol-delivery device, at a variable velocity, along a flowpath to an aerosol-sensor;

activate the fluid pump in the first direction for a second time after the first time at a target velocity less than the overshoot velocity;

activate the fluid pump in a second direction for a third time after the second time at a reversal velocity; and activate the fluid pump for a fourth time in the second direction after the third time at a second reversal velocity less than the reversal velocity.

8. The system of claim 7, wherein the reversal velocity is greater than the target velocity.

9. The system of claim 7, wherein the operations cause the fluid in the flowpath to flow faster than the target velocity for a first duration, and then return to the target velocity for a second duration.

10. The system of claim 9, wherein the second duration is more than five times the first duration.

11. The system of claim 7, wherein the operations cause the fluid to flow along the flowpath with a velocity characterized by a pseudotrapezoidal flow pattern, the pseudotrapezoidal flow pattern having a period of greater-than-target velocity.

12. The system of claim 7, wherein the system further comprises a sensor-controller communicably coupled to the aerosol-sensor and configured to generate a reading from the aerosol-sensor.

13. A method comprising:

driving a fluid pump, in a first direction for a first time at an overshoot velocity, wherein the fluid pump is capable of producing a flow of smoking article vapor, at a variable velocity, along a flowpath to an aerosol-sensor;

driving the fluid pump in the first direction for a second time after the first time at a target velocity less than the overshoot velocity;

driving the fluid pump in a second direction for a third time after the second time at a reversal velocity; and driving the fluid pump for a fourth time in the second direction after the third time at a second reversal velocity less than the reversal velocity.

14. The method of claim 13, wherein the reversal velocity is greater than the target velocity.

15. The method of claim 13, wherein the method causes the fluid in the flowpath to flow faster than the target velocity for a first duration, and then return to the target velocity for a second duration.

16. The method of claim 15, wherein the second duration is more than five times the first duration.

17. The method of claim 13, wherein the method causes the fluid to flow along the flowpath with a velocity characterized by a pseudotrapezoidal flow pattern, the pseudotrapezoidal flow pattern having a period of greater-than-target velocity.

18. The method of claim 13, wherein a sensor-controller is communicably coupled to the aerosol-sensor and is configured to generate a reading from the aerosol-sensor.

* * * * *